US005893993A

United States Patent [19]

Kurano

[11] Patent Number: 5,893,993

[45] Date of Patent: Apr. 13, 1999

[54] GLOW PLUG WITH ION SENSING ELECTRODE

[75] Inventor: Atsushi Kurano, Kuwana, Japan

[73] Assignee: Denso Corporation, Japan

[21] Appl. No.: 08/919,369

[22] Filed: Aug. 28, 1997

[30] Foreign Application Priority Data

Sep. 12, 1996 [JP] Japan ..... 8-265543

[51] Int. Cl.[6] ..... F23Q 7/00

[52] U.S. Cl. ..... 219/270; 123/145 A

[58] Field of Search ..... 219/270, 267, 219/544; 123/145 A, 145 R; 361/264–266

[56] References Cited

U.S. PATENT DOCUMENTS 4,739,731 4/1988 Häbich et al. .

FOREIGN PATENT DOCUMENTS 456245 11/1991 European Pat. Off. .
3706555 1/1988 Germany .
3904022 8/1989 Germany .
7-259597 10/1995 Japan .

*Primary Examiner*—John A. Jeffery
*Attorney, Agent, or Firm*—Pillsbury Madison & Sutro, LLP

[57] ABSTRACT

A glow plug includes a housing. A main body is at least partially disposed in the housing. The main body is supported with respect to the housing. An insulating member is included in the main body. A heating member is provided in the insulating member. A pair of lead wires are electrically connected to two ends of the heating member respectively. The lead wires extend out of the insulating member. At least one ion sensing electrode is provided in the insulating member. The ion sensing electrode is electrically connected to the heating member. The ion sensing electrode is operative for detecting a condition of ionization in a flame. The ion sensing electrode has a tip uncovered from the insulating member so as to be exposed to the flame. The heating member has a given portion extending between a center with respect to the electrical connection with the ion sensing electrode and an end of the heating member which is a negative side when a heating dc current is driven through the heating member. An electric resistance of the given portion of the heating member is smaller than an electric resistance of the ion sensing electrode between its tip and the electrical connection with the heating member.

5 Claims, 16 Drawing Sheets

FIG. 11

| SAMPLE NUMBER | ELECTRIC RESISTANCE (Ω) | | | CARBON REMOVAL |
|---|---|---|---|---|
| | R2 | r | CARBON | |
| 1 | 0.4 | 1.0 | 0.2 | ○ |
| 2 | 0.4 | 0.8 | | ○ |
| 3 | 0.4 | 0.6 | | ○ |
| 4 | 0.4 | 0.5 | | △ |
| 5 | 0.4 | 0.4 | | × |
| 6 | 0.4 | 0.2 | | × |

* ○ · · · EXCELLENT △ · · · GOOD × · · · NO GOOD

FIG. 12

| SAMPLE NUMBER | CONDUCTIVE CERAMIC | | INSULATING CERAMIC | CARBON REMOVAL | |
|---|---|---|---|---|---|
| | HEATING MEMBER | ION SENSING ELECTRODE | | NO. 3 | NO. 6 |
| 7 | WC | WC | $Si_3N_4$ | ○ | × |
| 8 | $Mo_2C$ | $Mo_2C$ | $Si_3N_4$ | ○ | × |
| 9 | TiN | TiN | $Si_3N_4$ | ○ | × |
| 10 | $WSi_2$ | $WSi_2$ | $Si_3N_4$ | ○ | × |
| 11 | $Mo_{4.8}Si_3Co_{0.6}$ | $Mo_{4.8}Si_3Co_{0.6}$ | $Si_3N_4$ | ○ | × |
| 12 | MoB | MoB | $Si_3N_4$ | ○ | × |
| 13 | $TiB_2$ | $TiB_2$ | $Si_3N_4$ | ○ | × |
| 14 | $ZrB_2$ | $ZrB_2$ | $Si_3N_4$ | ○ | × |
| 15 | WC | $MoSi_2$ | $Si_3N_4$ | ○ | × |
| 16 | $Mo_2C$ | $MoSi_2$ | $Si_3N_4$ | ○ | × |
| 17 | TiN | $MoSi_2$ | $Si_3N_4$ | ○ | × |
| 18 | $WSi_2$ | $MoSi_2$ | $Si_3N_4$ | ○ | × |
| 19 | $Mo_{4.8}Si_3Co_{0.6}$ | $MoSi_2$ | $Si_3N_4$ | ○ | × |
| 20 | MoB | $MoSi_2$ | $Si_3N_4$ | ○ | × |
| 21 | $TiB_2$ | $MoSi_2$ | $Si_3N_4$ | ○ | × |
| 22 | $ZrB_2$ | $MoSi_2$ | $Si_3N_4$ | ○ | × |

○ · · · EXCELLENT
× · · · NO GOOD

FIG. 13

| SAMPLE NUMBER | CONDUCTIVE CERAMIC | | INSULATING CERAMIC | CARBON REMOVAL | |
|---|---|---|---|---|---|
| | HEATING MEMBER | ION SENSING ELECTRODE | | NO. 3 | NO. 6 |
| 23 | $Mo_2C$ | $MoSi_2$ | $Al_2O_3$ | ○ | × |
| 24 | WC | WC | $Al_2O_3$ | ○ | × |
| 25 | $Mo_2C$ | $Mo_2C$ | $Al_2O_3$ | ○ | × |
| 26 | TiN | TiN | $Al_2O_3$ | ○ | × |
| 27 | $WSi_2$ | $WSi_2$ | $Al_2O_3$ | ○ | × |
| 28 | $Mo_{4.8}Si_3Co_{0.6}$ | $Mo_{4.8}Si_3Co_{0.6}$ | $Al_2O_3$ | ○ | × |
| 29 | MoB | $MoSi_2$ | $Al_2O_3$ | ○ | × |
| 30 | $TiB_2$ | $MoSi_2$ | $Al_2O_3$ | ○ | × |
| 31 | $ZrB_2$ | $MoSi_2$ | $Al_2O_3$ | ○ | × |
| 32 | $MoSi_2$ | $MoSi_2$ | BN | ○ | × |
| 33 | WC | WC | BN | ○ | × |
| 34 | $Mo_2C$ | $Mo_2C$ | BN | ○ | × |
| 35 | TiN | TiN | BN | ○ | × |
| 36 | $WSi_2$ | $WSi_2$ | BN | ○ | × |
| 37 | $Mo_{4.8}Si_3Co_{0.6}$ | $Mo_{4.8}Si_3Co_{0.6}$ | BN | ○ | × |
| 38 | MoB | $MoSi_2$ | BN | ○ | × |
| 39 | $TiB_2$ | $MoSi_2$ | BN | ○ | × |
| 40 | $ZrB_2$ | $MoSi_2$ | BN | ○ | × |

○ · · · EXCELLENT
× · · · NO GOOD

FIG. 14

| SAMPLE NUMBER | CONDUCTIVE CERAMIC | | INSULATING CERAMIC | CARBON REMOVAL | |
|---|---|---|---|---|---|
| | HEATING MEMBER | ION SENSING ELECTRODE | | NO. 3 | NO. 6 |
| 41 | WC | WC | NOT ADDED | ○ | × |
| 42 | $Mo_2C$ | $Mo_2C$ | NOT ADDED | ○ | × |
| 43 | TiN | TiN | NOT ADDED | ○ | × |
| 44 | $WSi_2$ | $WSi_2$ | NOT ADDED | ○ | × |
| 45 | $Mo_{4.8}Si_3C_{0.6}$ | $Mo_{4.8}Si_3C_{0.6}$ | NOT ADDED | ○ | × |
| 46 | MoB | MoB | NOT ADDED | ○ | × |
| 47 | $TiB_2$ | $TiB_2$ | NOT ADDED | ○ | × |
| 48 | $ZrB_2$ | $ZrB_2$ | NOT ADDED | ○ | × |
| 49 | $MoSi_2$ | $MoSi_2$ | NOT ADDED | ○ | × |

○ · · · EXCELLENT
× · · · NO GOOD

FIG. 15

| SAMPLE NUMBER | CONDUCTIVE CERAMIC | | ION SENSING ELECTRODE | CARBON REMOVAL | |
|---|---|---|---|---|---|
| | HEATING MEMBER | ION SENSING ELECTRODE | | NO. 3 | NO. 6 |
| 50 | $MoSi_2$ | $Si_3N_4$ | W | ○ | × |
| 51 | $MoSi_2$ | $Si_3N_4$ | Mo | ○ | × |
| 52 | $MoSi_2$ | $Si_3N_4$ | Ni | ○ | × |
| 53 | $MoSi_2$ | $Si_3N_4$ | Ti | ○ | × |
| 54 | $MoSi_2$ | $Si_3N_4$ | Fe-Cr-Ni | ○ | × |
| 55 | $MoSi_2$ | $Si_3N_4$ | Ni-Co | ○ | × |
| 56 | $MoSi_2$ | $Si_3N_4$ | Fe-Co | ○ | × |
| 57 | $MoSi_2$ | $Si_3N_4$ | W-Re | ○ | × |

○ · · · EXCELLENT
× · · · NO GOOD

FIG. 16

| SAMPLE NUMBER | CONDUCTIVE CERAMIC | | INSULATING CERAMIC | | CARBON REMOVAL | |
|---|---|---|---|---|---|---|
| | HEATING MEMBER | ION SENSING ELECTRODE | CONDUCTIVE MATERIAL | INSULATING CERAMIC | NO. 3 | NO. 6 |
| 58 | $MoSi_2$ | $Si_3N_4$ | W | $Si_3N_4$ | ○ | × |
| 59 | $MoSi_2$ | $Si_3N_4$ | Mo | $Si_3N_4$ | ○ | × |
| 60 | $MoSi_2$ | $Si_3N_4$ | Ni | $Si_3N_4$ | ○ | × |
| 61 | $MoSi_2$ | $Si_3N_4$ | Ti | $Si_3N_4$ | ○ | × |
| 62 | $MoSi_2$ | $Si_3N_4$ | Fe-Cr-Ni | $Si_3N_4$ | ○ | × |
| 63 | $MoSi_2$ | $Si_3N_4$ | Ni-Co | $Si_3N_4$ | ○ | × |
| 64 | $MoSi_2$ | $Si_3N_4$ | Fe-Co | $Si_3N_4$ | ○ | × |

○ · · · EXCELLENT
× · · · NO GOOD

GLOW PLUG WITH ION SENSING ELECTRODE

BACKGROUND OF THE INVENTION

1. Field of the Invention

This invention relates to a glow plug for facilitating the ignition and the burning of an air-fuel mixture, and also a glow plug for an internal combustion engine.

2. Description of the Related Art

In recent years, more effective emission control has been demanded in spark-ignition internal combustion engines and diesel engines for the protection of environment. To meet such a demand, various proposals have been made. Examples of the proposals will be listed below. A first proposal relates to an improvement of the structure of an engine. A second proposal relates to after-treatment or post-treatment using a catalytic converter. A third proposal relates to an improvement of the properties of fuel or lubricant. A fourth proposal relates to an improvement of a burning control system for an engine.

A recent burning control system for an engine requires the detection of conditions of the burning of an air-fuel mixture in a combustion chamber of the engine. According to proposals, the pressure in a combustion chamber, the light generated by the burning of an air-fuel mixture, the ion current related to the combustion chamber, and other physical parameters are detected as an indication of conditions of the burning of the air-fuel mixture.

The detection of burning conditions in response to an ion current means a direct observation of a chemical reaction caused during the burning of an air-fuel mixture. Accordingly, it is thought that the ion-current-based detection is useful. Various methods of detecting an ion current have been proposed.

Japanese published unexamined patent application 7-259597 discloses a sensor for detecting the degree of ionization of gases in an engine combustion chamber. In Japanese application 7-259597, the sensor has a measurement sleeve electrode which is provided concentrically around a fuel injection nozzle extending into the engine combustion chamber from a cylinder head. The measurement sleeve electrode is insulated from walls of the fuel injection nozzle and walls of the cylinder head.

U.S. Pat. No. 4,739,731 discloses a ceramic glow plug designed to detect an ion current caused during the burning of an air-fuel mixture in an engine combustion chamber. In U.S. Pat. No. 4,739,731, the ceramic glow plug extends into the engine combustion chamber. A tip of the ceramic glow plug has an electrically conductive layer made of platinum. The ceramic glow plug contains an electrical conductor leading from the electrically conductive tip thereof. A direct voltage of 250 V is applied between the electrically conductive tip of the ceramic glow plug and the wall of the combustion chamber.

The sensor in Japanese application 7-259597 has the following problems. It is necessary to insulate the measurement sleeve electrode of the sensor from the walls of the fuel injection nozzle and the walls of the cylinder head. Therefore, laborious steps are required in making and locating the sensor. The measurement sleeve electrode of the sensor is expensive. As the related engine is used for a long term, carbon collects in a space between the measurement sleeve electrode and the walls of the fuel injection nozzle and a space between the measurement sleeve electrode and the walls of the cylinder head. In some cases, the measurement sleeve electrode is short-circuited to the walls of the fuel injection nozzle or the walls of the cylinder head by the collected carbon.

The ceramic glow plug of U.S. Pat. No. 4,739,731 has the following problem. A large amount of platinum is used in making the ceramic glow plug. Therefore, the ceramic glow plug is expensive.

SUMMARY OF THE INVENTION

It is an object of this invention to provide an improved glow plug which can solve the previously-indicated problems in the prior art.

A first aspect of this invention provides a glow plug comprising a housing; a main body at least partially disposed in the housing and supported with respect to the housing; an insulating member included in the main body; a heating member provided in the insulating member; a pair of lead wires electrically connected to two ends of the heating member respectively and extending out of the insulating member; and at least one ion sensing electrode provided in the insulating member and electrically connected to the heating member for detecting a condition of ionization in a flame; wherein the ion sensing electrode has a tip uncovered from the insulating member so as to be exposed to the flame; and wherein the heating member has a given portion extending between a center with respect to the electrical connection with the ion sensing electrode and an end of the heating member which is a negative side when a heating dc current is driven through the heating member, and an electric resistance of the given portion of the heating member is smaller than an electric resistance of the ion sensing electrode between its tip and the electrical connection with the heating member.

A second aspect of this invention is based on the first aspect thereof, and provides a glow plug wherein the ion sensing electrode is made from an electrically conductive ceramic material or from a mixture of the electrically conductive ceramic material and an insulating ceramic material, and a main component of the electrically conductive ceramic material includes at least one of metal silicide, metal carbide, metal nitride, and metal boride.

A third aspect of this invention is based on the first aspect thereof, and provides a glow plug wherein the ion sensing electrode is made from a high-melting-point metal material whose main component includes at least one metal material having a melting point equal to or above 1,200° C., or is made from a mixture of the high-melting-point metal material and an insulating ceramic material.

A fourth aspect of this invention is based on the first aspect thereof, and provides a glow plug wherein the tip of the ion sensing electrode has a coating of at least one of Pt, Ir, Rh, Ru, and Pd.

A fifth aspect of this invention provides a glow plug comprising an insulating member; a heating member provided in the insulating member; and an electrode provided in the insulating member and electrically connected to the heating member for sensing an ion current, the electrode having a surface uncovered from the insulating member; wherein an electric resistance of a portion of the heating member between an end of the heating member and the electrical connection with the electrode is smaller than an electric resistance of the electrode between the surface of the electrode and the electrical connection with the heating member.

BRIEF DESCRIPTION OF THE DRAWINGS

FIG. 11 is a table of characteristics of samples of a glow plug according to a second specific embodiment of this invention.

FIG. 12 is a table of characteristics of samples of a glow plug according to a third specific embodiment of this invention.

FIG. 13 is a table of characteristics of samples of a glow plug according to the third specific embodiment of this invention.

FIG. 14 is a table of characteristics of samples of a glow plug according to the third specific embodiment of this invention.

FIG. 15 is a table of characteristics of samples of a glow plug according to a fourth specific embodiment of this invention.

FIG. 16 is a table of characteristics of samples of a glow plug according to the fourth specific embodiment of this invention.

DESCRIPTION OF THE PREFERRED EMBODIMENTS

Basic Embodiment

Figure 1:
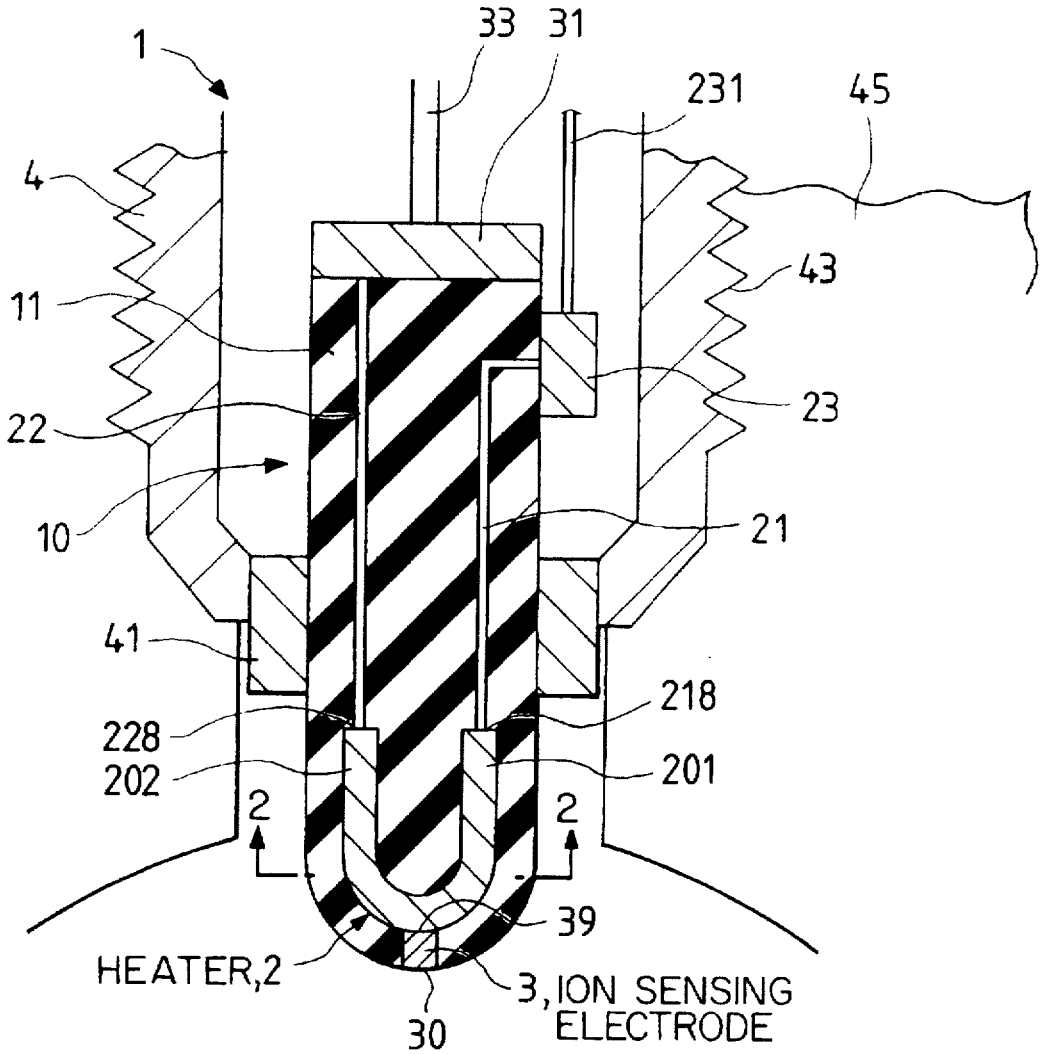
FIG. 1 is a sectional view of a portion of a glow plug according to a first specific embodiment of this invention.

According to a basic embodiment of this invention, a glow plug comprises a housing; a main body at least partially disposed in the housing and supported with respect to the housing; an insulating member included in the main body; a heating member provided in the insulating member; a pair of lead wires electrically connected to two ends of the heating member respectively and extending out of the insulating member; and at least one ion sensing electrode provided in the insulating member and electrically connected to the heating member for detecting a condition of ionization in a flame; wherein the ion sensing electrode has a tip uncovered from the insulating member so as to be exposed to the flame; and wherein the heating member has a given portion extending between a center with respect to the electrical connection with the ion sensing electrode and an end of the heating member which is a negative side when a heating dc current is driven through the heating member, and an electric resistance of the given portion of the heating member is smaller than an electric resistance of the ion sensing electrode between its tip and the electrical connection with the heating member.

The glow plug according to the basic embodiment of this invention features that the heating member and the ion sensing electrode are provided in the insulating member, and the electric resistance of the given portion of the heating member is smaller than the electric resistance of the ion sensing electrode between its tip and the electrical connection with the heating member.

The heating member has a first heating portion and a second heating portion. The first heating portion of the heating member extends between a center with respect to first electrical connection with the ion sensing electrode and an end of the heating member which is a positive side when the heating dc current is driven through the heating member. The second heating portion of the heating member extends between the center with respect to the first electrical connection with the ion sensing electrode and the end of the heating member which is the negative side when the heating dc current is driven through the heating member. The electric resistance of the first heating portion is denoted by R1.

The electric resistance of the second heating portion is denoted by R2.

The first electrical connection is a part of the heating member to which the ion sensing electrode is electrically connected first in a path from the positive end to the negative end. Generally, only one ion sensing electrode is provided with respect to the heating member. Two or more ion sensing electrodes may be provided with respect to the heating member.

In the case where plural ion sensing electrodes are provided, the first heating portion extends between the positive end and the ion sensing electrode closest to the positive end. The second heating portion extends between the negative end and the ion sensing electrode closest to the positive end. In this case, one or more ion sensing electrodes are connected to the second heating portion.

The electric resistance R2 of the second heating portion of the heating member is smaller than the electric resistance "r" of the ion sensing electrode. This design is implemented by suitably choosing materials for the second heating portion and the ion sensing electrode, and the thickness and the length of an electric current path.

For example, the second heating portion of the heating member is made from a mixture of electrically conductive ceramic powder and insulating ceramic powder. Also, the ion sensing electrode is made from a mixture of electrically conductive ceramic powder and insulating ceramic powder. It is preferable that the mixing weight ratio between the electrically conductive ceramic powder and the insulating ceramic powder for the second heating portion differs from that for the ion sensing electrode.

Materials for the heating member and the ion sensing electrode use electrically conductive ceramic which includes at least one of metal silicide, metal carbide, metal nitride, and metal boride. Examples of the electrically conductive ceramic are $MoSi_2$, $Mo_5Si_3$, $Mo_xSi_3C_y$ (x=4~5, y=0~1), MoB, WC, and TiN. The materials for the heating member and the ion sensing electrode use insulating ceramic of $Si_3N_4$, $Al_2O_3$, or BN. Rare-earth metal oxide of one or more types is added as sintering assistant.

An explanation will be given of the case where the electrically conductive ceramic uses $MoSi_2$, and the insulating ceramic uses $Si_3N_4$ and the sintering assistant uses $Y_2O_3$ and $Al_2O_3$. It is preferable that grain diameters of the $Si_3N_4$ powder are greater than those of the $MoSi_2$ powder. In this case, each $Si_3N_4$ grain is surrounded by successive $MoSi_2$ grains so that a sufficient electrical conductivity is available.

Preferably, the mean grain diameter of the $MoSi_2$ powder is equal to 1 μm while the mean grain diameter of the $Si_3N_4$ powder is equal to 15 μm. The sintering assistant has a mean grain diameter of 1 μm. It is preferable that the mixing weight ratio between the $MoSi_2$ powder and the $Si_3N_4$ powder is in the range from 10:90 to 60:40. For example, the mixing weight ratio between the $MoSi_2$ powder and the $Si_3N_4$ powder for the second heating portion of the heating member is equal to 40:60 while the mixing weight ratio between the $MoSi_2$ powder and the $Si_3N_4$ powder for the ion sensing electrode is equal to 20:80. In this case, the electric resistance R2 is smaller than the electric resistance "r".

As the sintering assistant, $Y_2O_3$ and $Al_2O_3$ are added by 10 weight-%. Alternatively, rare-earth metal oxide of $Yb_2O_3$, $La_2O_3$, or $Nd_2O_3$ may be used as sintering assistant. The sintering assistant may use at least one of the previously-indicated substances.

As previously explained, a mixture of the electrically conductive ceramic and the insulating ceramic is used. Alternatively, only the electrically conductive ceramic may be used. The mixture of the electrically conductive ceramic and the insulating ceramic may be replaced by a mixture of metal powder and the insulating ceramic. Only metal powder may be used. Only a metal wire may be used.

The insulating member is made as follows. Basic materials use electrically conductive ceramic powder of $MoSi_2$ and insulating ceramic powder of $Si_3N_4$. As sintering assistant, $Y_2O_3$ and $Al_2O_3$ are added to the basic materials. The resultant mixture is sintered into the insulating member. Preferably, grain diameters of the $Si_3N_4$ powder are equal to or slightly smaller than those of the $MoSi_2$ powder. In this case, $MoSi_2$ grains are surrounded by $Si_3N_4$ grains, and are hence separated from each other so that proper insulation is available. For example, the mean grain diameter of the $MoSi_2$ powder is equal to 0.9 μm while the mean grain diameter of the $Si_3N_4$ powder is equal to 0.6 μm.

It is more preferable that the mixing weight ratios between the different types of powder for the heating member, the ion sensing electrode, and the insulating member are equal or close to each other since differences among the thermal expansion coefficients of the heating member, the ion sensing electrode, and the insulating member are small. Rare-earth metal oxide such as yttrium oxide, ytterbium oxide, lanthanum oxide, or neodymium oxide may be used as the sintering assistant. The sintering assistant may use at least one of the previously-indicated substances.

For the heating characteristics of the glow plug, it is preferable that the electric resistance R2 of the second heating portion is in the range of 0.1 Ω to 2 Ω while the electric resistance "r" of the ion sensing electrode is in the range of 0.2 Ω to 3 Ω.

A molded member for the heating member and the ion sensing electrode is previously made. The molded member is placed or buried in an original member for the insulating member. The molded member for the heating member and the ion sensing electrode, and the original member for the insulating member are combined into a single unit by a molding process. During the molding process, the lead wires are connected to the molded member for the heating member and the ion sensing electrode. The lead wires are made of high-melting-point metal such as tungsten or molybdenum. The lead wires may be made of a tungsten-based alloy or a molybdenum-based alloy.

Alternatively, the following way may be used. Two halves of the original member for the insulating member are previously made. A molded member for the heating member and the ion sensing electrode is placed between the two halves.

The original member for the insulating member and the molded member for the heating member and the ion sensing electrode are made by, for example, an injection molding process using ceramic powder which is the materials therefor.

The heating member and the ion sensing electrode may be formed in the insulating member by a printing process. An example of the printing process is as follows. A green sheet for the insulating member is prepared. The green sheet is made of ceramic material. The heating member, the lead wires, and the ion sensing electrode having desired shapes are provided on a surface of the green sheet by screen printing, pad printing, or hot stamping. The heating member, the lead wires, and the ion sensing electrode are made of electrically conductive materials. The resultant sheet is made into a roll. The roll is fired or sintered. As a result, the insulating member is completed which has the heating member, the lead wires, and the ion sensing electrode formed by the printing process. It should be noted that the green sheet for the insulating member may be replaced by a sheet-like member formed by a pressing process using a die assembly.

The injection-molding-resultant member or the printing-resultant member is fired or sintered by hot pressing, being thereby subjected to pressure sintering within an atmosphere of argon for 60 minutes. Conditions of the pressure sintering are as follows. The applied pressure is equal to 400 kg/cm$^2$. The sintering temperature (the firing temperature) is equal to 1,800° C.

In the glow plug according to the basic embodiment of this invention, the heating member is heated when being supplied with an electric current. This heating process aids the ignition and the burning of an air-fuel mixture in a combustion chamber.

The ion sensing electrode serves to sense a condition of ionization in a flame. During the detection of an ion current, the ion sensing electrode and the inner walls (cylinder head walls) of the combustion chamber close thereto form two opposite electrodes for capturing positive and negative ions present in a region between the two opposite electrodes.

Thereby, it is possible to accurately detect the ion current. Information of the ion current can be used in the control of the burning of the air-fuel mixture. The glow plug is provided with both the function of heating air in the combustion chamber and the function of detecting an ion current. Therefore, the glow plug is compact in structure, and is low in price.

In some cases, carbon adheres to outer surfaces of the ion sensing electrode and the insulating member, and electrically short-circuits the ion sensing electrode to the cylinder head. In these cases, the heating member is supplied with a dc current to heat the whole of the glow plug and thereby to burn the carbon away from the surfaces of the ion sensing electrode and the insulating member. As previously explained, in the glow plug according to the basic embodiment of this invention, the electric resistance R of the second heating portion of the heating member is smaller than the electric resistance "r" of the ion sensing electrode. Therefore, a greater portion of the dc current, which has entered the heating member via the positive end thereof, is directed from the first heating portion of the heating member to the second heating portion thereof. On the other hand, the dc current hardly leaks toward the ion sensing electrode and the carbon. Thus, the first heating portion and the second heating portion of the heating member are effectively heated, and thereby the insulating member and the ion sensing electrode are also heated. The carbon on the outer surfaces of the insulating member and the ion sensing electrode is oxidized by air in the combustion chamber and is burned away from the outer surfaces of the insulating member and the ion sensing electrode as the insulating member and the ion sensing electrode are heated. As a result, the glow plug and the ion sensing electrode therein return to their normal states.

As understood from the previous explanation, it is possible to easily remove the carbon-caused short circuit between the ion sensing electrode and the cylinder head. Thus, it is possible to accurately detect an ion current for a long term.

In the glow plug according to the basic embodiment of this invention, the heating member is buried in the insulating member to be prevented from being exposed to the flame. Thus, it is possible to prevent the heating member from being corroded by the flame. Also, it is possible to prevent the heating member from being damaged by thermal shock in the combustion chamber. Furthermore, it is possible to prevent the heating member from changing in resistance and heating characteristics. Accordingly, the heating member can operate normally for a long term.

In the glow plug according to the basic embodiment of this invention, the heating member, the lead wires, and the ion sensing electrode are provided in the insulating member. Thus, the glow plug has a simple structure.

In the glow plug according to the basic embodiment of this invention, carbon adhering to the outer surfaces of the ion sensing electrode and the insulating member is prevented from causing a problem since the carbon can be removed therefrom. Thus, it is possible to accurately detect an ion current. In addition, the glow plug is durable.

It is preferable that the ion sensing electrode is made from an electrically conductive ceramic material or from a mixture of the electrically conductive ceramic material and an insulating ceramic material, and a main component of the electrically conductive ceramic material includes at least one of metal silicide, metal carbide, metal nitride, and metal boride. In this case, good heat resisting properties of the glow plug are available. Also, good thermal-shock withstanding properties of the glow plug are available since the thermal expansion coefficients of the ion sensing electrode and the insulating member can be easily matched.

It is preferable that the ion sensing electrode is made from a high-melting-point metal material whose main component includes at least one metal material having a melting point equal to or above 1,200° C., or is made from a mixture of the high-melting-point metal material and an insulating ceramic material. The high-melting-point metal material can use a wire. Therefore, the advantage of cost reduction is available regarding materials, processing, and assembly. Good heat resisting properties of the ion sensing electrode are available. Also, a good oxidation resistance of the ion sensing electrode is available. In addition, the thermal expansion coefficient of the ion sensing electrode can be easily matched with those of the heating member and the insulating member. Therefore, the glow plug is durable. During the heating operation of the glow plug, the heating member is generally heated at a temperature in the range of 1,000° C. to 1,100° C. Thus, the above-indicated melting point being equal to or above 1,200° C. ensures good heat resisting properties of the ion sensing electrode.

It is preferable that the tip of the ion sensing electrode has a coating of at least one of Pt, Ir, Rh, Ru, and Pd. In this case, the ion sensing electrode is durable. Also, a good oxidation resistance of the ion sensing electrode is available.

First Specific Embodiment

Figure 2:
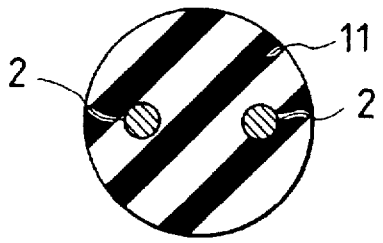
FIG. 2 is a sectional view taken along the line 2—2 in FIG. 1.

FIGS. 1 and 2 show a glow plug 1 used for preheating air in an engine combustion chamber and aiding a related engine in starting. The glow plug 1 is designed to detect an ion current caused during the burning of an air-fuel mixture in the engine combustion chamber.

With reference to FIGS. 1 and 2, the glow plug 1 includes a housing 4 and a main body 10. The main body 10 is supported with respect to the housing 4. Specifically, the main body 10 is fixed to a lower end of the housing 4 via a ring member 41 made of metal. The ring member 41 may be a part of the housing 4. An upper portion of the main body 10 is located within the housing 4. A lower portion of the main body 10 extends from the housing 4 into the engine combustion chamber.

The main body 10 includes an insulating member 11, a heating member 2, and a pair of lead wires 21 and 22. The heating member 2 is heated when an electric current flows therethrough. The heating member 2 has a shape of the letter "U". The heating member 2 has a circular cross section. The heating member 2 is provided within the insulating member 11. Specifically, the heating member 2 is buried in the insulating member 11. The lead wires 21 and 22 extend in the insulating member 11. A first end of the lead wire 21 is electrically connected to a first end of the heating member 2. A second end of the lead wire 21 reaches a side surface of the insulating member 11. A first end of the lead wire 22 is electrically connected to a second end of the heating member 2. A second end of the lead wire 22 reaches an upper end surface of the insulating member 11.

The main body 10 also includes an ion sensing electrode 3. The ion sensing electrode 3 is used in detecting the conditions of ionization of a flame in the engine combustion chamber, for example, the degree of ionization of a flame in the engine combustion chamber. The ion sensing electrode 3 is provided in the insulating member 11. The ion sensing electrode 3 is electrically connected to a mid point of the heating member 2. A part of the ion sensing electrode 3 is exposed at a lower end surface of the insulating member 11. Accordingly, this part of the ion sensing electrode 3 can be subjected to the flame in the engine combustion chamber.

Figure 3:
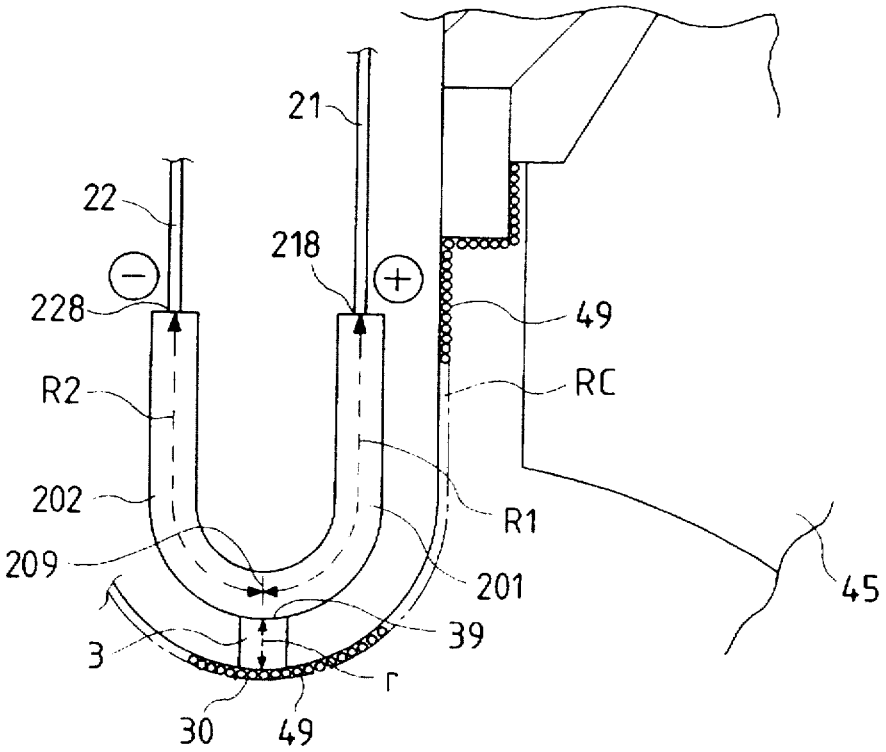
FIG. 3 is a sectional view of a portion of the glow plug according to the first specific embodiment of this invention.

With reference to FIGS. 1 and 3, the heating member 2 has two ends 218 and 228 which will form a positive side and a negative side respectively when the heating member 2 is supplied with a heating electric current. The heating member 2 is divided into two regions 201 and 202. The first region 201 of the heating member 2 extends between the positive end 218 thereof and a center 209 with respect to the junction 39 between the heating member 2 and the ion sensing electrode 3. The second region 202 of the heating member 2 extends between the negative end 228 thereof and the center 209 with respect to the junction 39 between the heating member 2 and the ion sensing electrode 3. It is preferable that the electric resistance R2 of the second region 202 of the heating member 2 is smaller than the electric resistance "r" of the ion sensing electrode 3 between its tip (its lower end) 30 and the junction 39 with the heating member 2. In other words, there is a relation as "R2<r".

In the insulating member 11, the lead wire 21 extends upward from the first end of the heating member 2. The lead wire 21 reaches an electrically conductive terminal 23 provided on the side surface of the main body 10. The lead wire 21 is electrically connected to a lead wire 231 via the terminal 23. In the insulating member 11, the lead wire 22 extends upward from the second end of the heating member 2. The lead wire 22 reaches an electrically conductive terminal 31 provided on an upper end of the insulating member 11. The lead wire 22 is electrically connected to a lead wire 33 via the terminal 31.

The ion sensing electrode 3 is formed integrally with a lowermost portion of the heating member 2. The tip (the lower end) 30 of the ion sensing electrode 3 has a coating of platinum (Pt).

Figure 4:
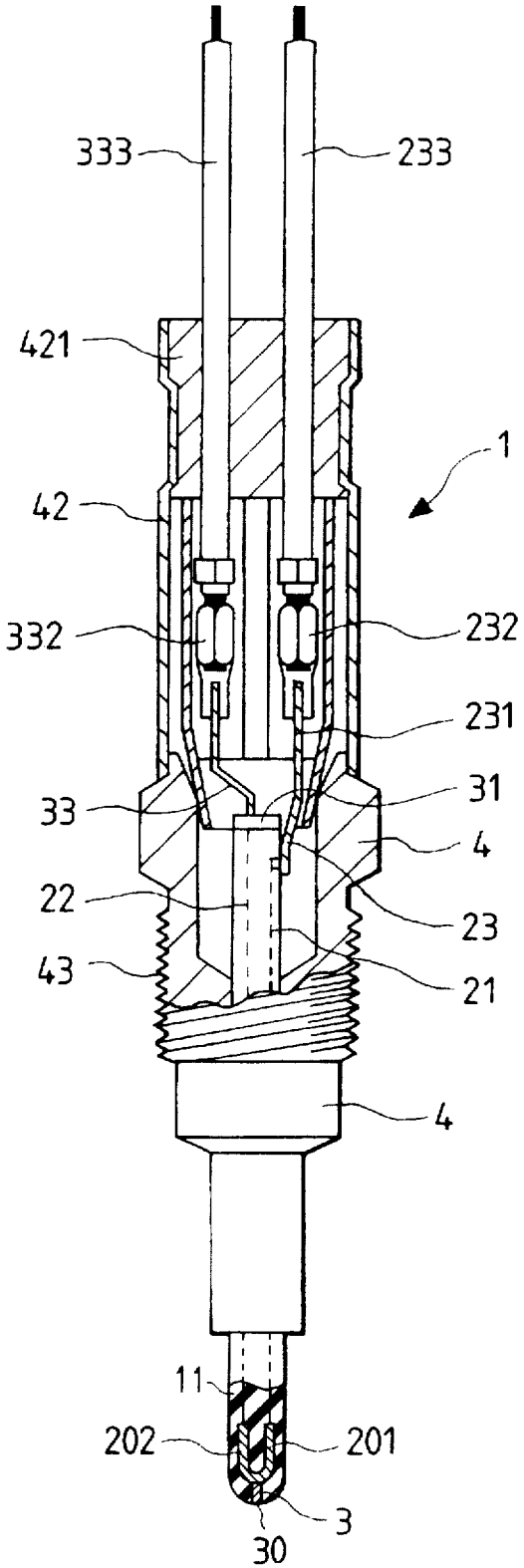
FIG. 4 is a view, partially in cross section, of the glow plug according to the first specific embodiment of this invention.

As shown in FIG. 4, an upper portion of the housing 4 includes a protective tube 42. Outer surfaces of the housing 4 have threads 43 forming a male screw in engagement with female threads in walls of an engine cylinder head 45 (see FIG. 1). Thereby, the housing 4 is fixed to the cylinder head 45. A rubber bush 421 fits into an upper opening of the protective tube 42. Lead wires 233 and 333 extend through the rubber bush 421. The lead wires 233 and 333 are electrically connected to the lead wires 231 and 33 via terminals 232 and 332, respectively. Accordingly, the lead wire 233 is electrically connected to the first end of the heating member 2 while the lead wire 333 is electrically connected to the second end of the heating member 2. Furthermore, the lead wires 233 and 333 are electrically connected to the ion sensing electrode 3.

The tip of the main body 10, that is, the lower end of the main body 10 (the lower end of the insulating member 11), is hemispherical. The tip 30 (the lower end) of the ion sensing electrode 3 forms a part of the hemispherical surface of the main body 10.

Figure 5:
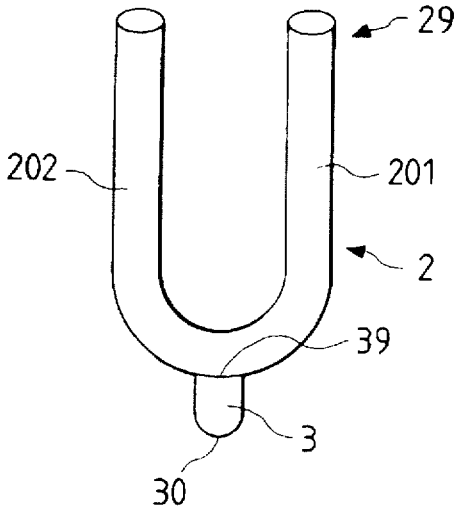
FIG. 5 is a perspective view of a molded member which will form a heating member and an ion sensing electrode in FIG. 1.

The main body 10 of the glow plug 1 was made as follows. As shown in FIG. 5, a U-shaped molded member 29 forming the heating member 2 and the ion sensing electrode 3 was prepared. The U1 shaped molded member 29 was made by mixing ceramic powder and binder, and subjecting the resultant mixture to injection molding. The U-shaped molded member 29 may be made from ceramic powder from press molding. The binder contained paraffin wax as a main component. The binder contained resin as a sub component.

The lead wires 21 and 22 were connected to the U-shaped molded member 29. Subsequently, the U-shaped molded member 29 was placed or buried in an original member for the insulating member 11. The original member is made of ceramic powder. The U-shaped molded member 29 and the original member for the insulating member 11 were fired or sintered by hot pressing, being thereby subjected to pressure sintering within an atmosphere of argon for 60 minutes. Conditions of the pressure sintering were as follows. The applied pressure was equal to 400 kg/cm$^2$. The sintering temperature (the firing temperature) was equal to 1,800° C.

The ceramic powder for the heating member 2 was a mixture of electrically conductive ceramic of $MoSi_2$, insulating ceramic of $Si_3N_4$, and sintering assistant of $Y_2O_3$ and $Al_2O_3$. The mixing weight ratio between $MoSi_2$ and $Si_3N_4$ was equal to 40:60. The mean grain diameter of the $MoSi_2$ powder was equal to 1 μm. The mean grain diameter of the $Si_3N_4$ powder was equal to 15 μm.

Regarding the sintering assistant, 5% $Y_2O_3$ and 5% $Al_2O_3$ were added to the combination of the $MoSi_2$ powder and the $Si_3N_4$ powder by weight. The mean grain diameter of the $Y_2O_3$ powder was equal to 1 μm. The mean grain diameter of the $Al_2O_3$ powder was equal to 1 μm.

The ceramic powder for the ion sensing electrode 3 was a mixture of electrically conductive ceramic of $MoSi_2$, insulating ceramic of $Si_3N_4$, and sintering assistant of $Y_2O_3$ and $Al_2O_3$. The mixing weight ratio between $MoSi_2$ and $Si_3N_4$ was equal to 20:80. The mean grain diameter of the $MoSi_2$ powder was equal to 1 μm. The mean grain diameter of the $Si_3N_4$ powder was equal to 15 μm. Regarding the sintering assistant, 5% $Y_2O_3$ and 5% $Al_2O_3$ were added to the combination of the $MoSi_2$ powder and the $Si_3N_4$ powder by weight. The mean grain diameter of the $Y_2O_3$ powder was equal to 1 μm. The mean grain diameter of the $Al_2O_3$ powder was equal to 1 μm.

The ceramic powder for the insulating member 11 was a mixture of electrically conductive ceramic of $MoSi_2$, insulating ceramic of $Si_3N_4$, and sintering assistant of $Y_2O_3$ and $Al_2O_3$. The mixing weight ratio between $MoSi_2$ and $Si_3N_4$ was equal to 30:70. The mean grain diameter of the $MoSi_2$ powder was equal to 1 μm. The mean grain diameter of the $Si_3N_4$ powder was equal to 1 μm. Regarding the sintering assistant, 5% $Y_2O_3$ and 5% $Al_2O_3$ were added to the combination of the $MoSi_2$ powder and the $Si_3N_4$ powder by weight. The mean grain diameter of the $Y_2O_3$ powder was equal to 1 μm. The mean grain diameter of the $Al_2O_3$ powder was equal to 1 μm.

Figure 6:
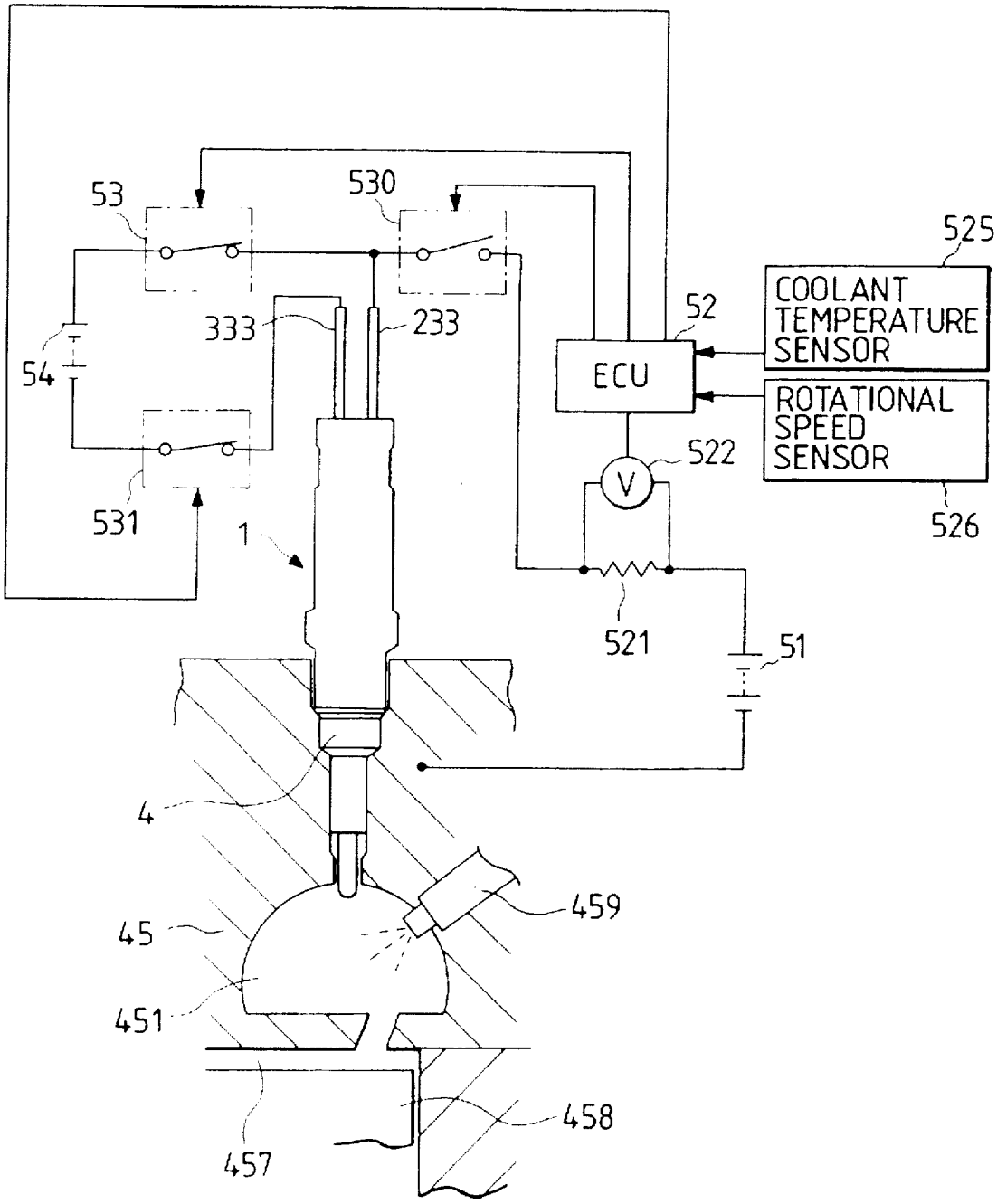
FIG. 6 is a diagram of the glow plug and a drive circuit for the glow plug according to the first specific embodiment of this invention.

As shown in FIG. 6, the glow plug 1 is attached to the cylinder head 45 by moving the male threads of the housing 4 into engagement with the female threads of the cylinder head 45. When the glow plug 1 is set in position relative to the cylinder head 45, the tip of the main body 10 of the glow plug 1 projects into a swirl chamber 451 which is a part of the engine combustion chamber. The swirl chamber 451 communicates with a main part 457 of the engine combustion chamber which is defined between a piston 458 and a lower surface of the cylinder head 45. A fuel injection nozzle 459 extends into the swirl chamber 451.

As previously explained, the lead wire 233 is electrically connected to the first end of the heating member 2 while the lead wire 333 is electrically connected to the second end of the heating member 2. As shown in FIG. 6, the lead wire 233 is electrically connected to the positive terminal of a battery 54 via a relay 53. The battery 54 generates a voltage of, for example, 12 V. The lead wire 333 is electrically connected to the negative terminal of the battery 54 via a relay 531. In this way, there is provided a drive circuit for the heating member 2 which includes the battery 54.

As previously explained, the lead wire 233 is electrically connected to the ion sensing electrode 3. As shown in FIG. 6, the lead wire 233 is electrically connected to the positive terminal of a dc power supply 51 via a relay 530 and a fixed resistor 521 used for sensing an ion current. The dc power supply 51 generates a voltage of, for example, 12 V. The resistance of the fixed resistor 521 is equal to, for example, about 500 kΩ. The negative terminal of the dc power supply 51 is electrically connected to the cylinder head 45. A potentiometer 522 is electrically connected across the fixed resistor 521 to measure an ion current. The potentiometer 522 is electrically connected to an electronic control unit (ECU) 52. Control terminals of the relays 53, 530, and 531 are electrically connected to the ECU 52. An engine coolant temperature sensor 525 and a rotational engine speed sensor 526 are electrically connected to the ECU 52.

The ECU 52 includes a microcomputer or a similar device which has a combination of an input/output port, a CPU, a ROM, and a RAM. The ECU 52 operates in accordance with a program stored in the ROM.

The ECU 52 is programmed to implement the following processes. During a start of the engine, the ECU 52 sets the relays 53 and 531 to their on positions. As a result, the electrical connection between the battery 54 and the heating member 2 of the glow plug 1 is established, and an electric current generated by the battery 54 flows through the heating member 2. Thus, the heating member 2 is activated by the electric current. The heating member 2 is heated by the electric current so that the glow plug 1 is also heated. Air in the swirl chamber 451 is heated by the glow plug 1. Accordingly, a preheating process is executed. When the preheating process is completed, the temperature of air in the swirl chamber 451 reaches a level at which an air-fuel mixture can spontaneously ignite. After the preheating process is completed, fuel is injected into the swirl chamber 451 via the fuel injection nozzle 459. The injected fuel and the air form a mixture which ignites. Thus, the burning of the air-fuel mixture starts. The burning of the air-fuel mixture progresses while the related flame is propagated from the swirl chamber 451 to the main part 457 of the engine combustion chamber. Thereby, a high pressure and a high temperature occur in the main part 457 of the engine combustion chamber, moving the piston 458 downward. As a result, the engine is started.

During operation of the engine, the ECU 52 changes the relays 53 and 531 to their off positions and, on the other hand, sets the relay 530 to its on position. The dc power supply 51 applies a voltage between the ion sensing electrode 3 of the glow plug 1 and the cylinder head 45. Ions are generated during the burning of the air-fuel mixture. The generated ions cause an electric current, that is, an ion current, with the aid of the voltage applied by the dc power supply 51. The ion current flows along a closed-loop path containing the swirl chamber 451, the ion sensing electrode 3, the lead wire 233, the relay 530, the fixed resistor 521, the dc power supply 51, and the cylinder head 45. A voltage across the fixed resistor 521 is proportional to the ion current. The potentiometer 522 detects the voltage across the fixed resistor 521, and outputs a signal representative of the ion current to the ECU 52.

A detailed explanation will be given of the detection of the ion current. Fuel is injected into the swirl chamber 451 via the fuel injection nozzle 459. The injected fuel and the air forms a mixture. The air-fuel mixture spontaneously ignites and then burns. A large number of positive ions and negative ions is generated in the flame of the burning. Since the dc power supply 51 applies a voltage between the ion sensing electrode 3 and the cylinder head 45, negative ions are attracted and captured by the ion sensing electrode 3 while positive ions are attracted and captured by the walls of the cylinder head 45. Thus, an ion current flows along a closed-loop path containing the fixed resistor 521. A voltage proportional to the ion current is developed across the fixed resistor 521. The potentiometer 522 detects the voltage across the fixed resistor 521, and outputs a signal representative of the ion current to the ECU 52.

The ECU 52 derives information of the ion current from the output signal of the potentiometer 522. The ECU 52 receives an output signal of the engine coolant temperature sensor 525. The ECU 52 derives information of the temperature Tw of engine coolant from the output signal of the engine coolant temperature sensor 525. The ECU 52 receives an output signal of the rotational engine speed sensor 526. The ECU 52 derives information of the rotational engine speed Ne from the output signal of the rotational engine speed sensor 526.

In the case where the engine is required to start when the temperature of the engine is relatively low, the ECU 52 controls the relays 53 and 531 to activate the heating member 2 of the glow plug 1. The activation of the heating member 2 implements a preheating process, thereby aiding the ignition and the burning of an air-fuel mixture. The ECU 52 monitors the ion current during a time interval after the start of the engine. At an initial stage of the start of the engine, the ECU 52 sets the relays 53 and 531 to their on positions so that the heating member 2 remains activated.

Figure 7:
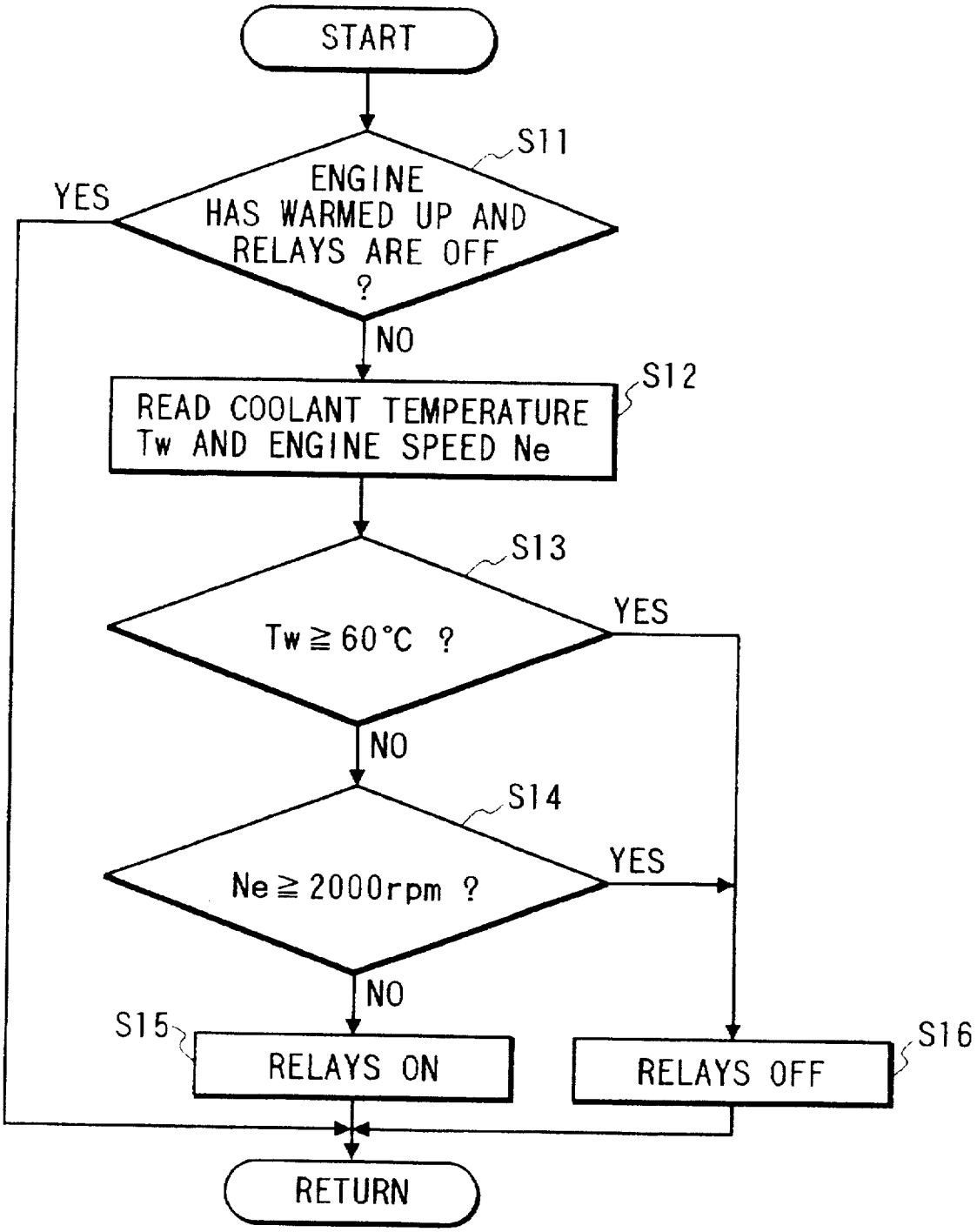
FIG. 7 is a flowchart of a segment of a program related to operation of an electronic control unit (ECU) in FIG. 6.

FIG. 7 is a flowchart of a segment (a sub routine) of the program related to operation of the ECU 52. The program segment in FIG. 7 is iteratively executed at a predetermined period in the case where the engine is required to start. The iterative execution of the program segment is implemented by a timer-based interruption process.

As shown in FIG. 7, a first step S11 of the program segment decides whether or not the engine has warmed up and the relays 53 and 531 are in their off positions. In the case where the engine has warmed up and the relays 53 and 531 are in their off positions, the program exits from the step S11 and the current execution cycle of the program segment ends before the program returns to a main routine. Otherwise, the program advances from the step S11 to a step S12.

The step S12 derives the current coolant temperature Tw from the output signal of the engine coolant temperature sensor 525. The step S12 derives the current rotational engine speed Ne from the output signal of the rotational engine speed sensor 526.

A step S13 following the step S12 compares the current coolant temperature Tw with a predetermined reference temperature to decide whether or not the engine has warmed up. The predetermined reference temperature is equal to, for example, 60° C. When the current coolant temperature Tw is equal to or higher than the predetermined reference temperature (60° C.), that is, when the engine has warmed up, the program advances from the step S13 to a step S16. Otherwise, the program advances from the step S13 to a step S14.

The step S14 compares the current rotational engine speed Ne with a predetermined reference speed equal to, for example, 2,000 rpm. When the current rotational engine speed Ne is equal to or higher than the predetermined reference speed (2,000 rpm), the program advances from the step S14 to the step S16. Otherwise, the program advances from the step S14 to a step S15.

The step S15 sets the relays 53 and 531 to their on positions to activate the heating member 2 of the glow plug 1. After the step S15, the current execution cycle of the program segment ends and then the program returns to the main routine.

The step S16 sets the relays 53 and 531 to their off positions to deactivate the heating member 2 of the glow plug 1. After the step S16, the current execution cycle of the program segment ends and then the program returns to the main routine.

Figure 8:
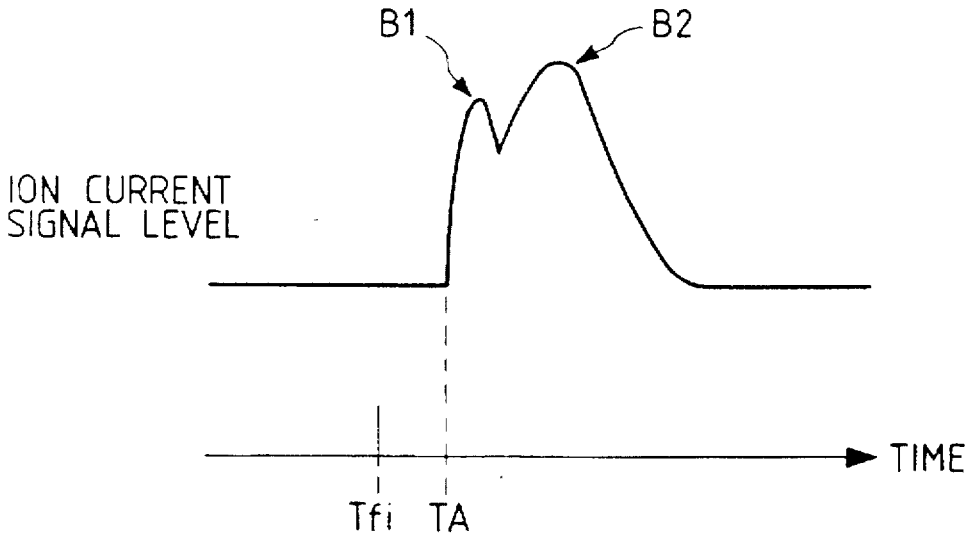
FIG. 8 is a time-domain diagram of an ion-current signal level which occurs under normal conditions of an ion sensing electrode.

FIG. 8 shows the waveform of a voltage signal representative of an ion current which occurs during operation of the engine. The voltage signal is, for example, the output signal of the potentiometer 522. The waveform of the voltage signal can be monitored by an oscilloscope.

With reference to FIG. 8, the signal level abruptly rises at a moment TA immediately after a moment Tfi of fuel injection which corresponds to a compression TDC (a compression top dead center) in crank angle. The moment TA is a time position of start of the burning of an air-fuel mixture, that is, a time position of ignition of the air-fuel mixture. The signal level peaks at two different time points following the moment TA. The first peak B1 is caused by the generation of ions in the spreading flame during an initial stage of the burning of the air-fuel mixture. The second peak B2 is caused by re-ionization due to a rise in the combustion-chamber pressure during intermediate and later stages of the burning of the air-fuel mixture.

The ECU 52 is programmed to implement the following processes. The ECU 52 detects an actual ignition timing from the first peak B1 of the signal level. The ECU 52 controls a fuel injection timing in response to the detected ignition timing on a feedback control basis to move and maintain the actual ignition timing toward and at a desired ignition timing (a target ignition timing). The ECU 52 detects the occurrence of abnormal burning or a misfire as burning conditions from the second peak B2 of the signal level. The ECU 52 controls fuel injection in response to the detected burning conditions. In this way, the ECU 52 uses information of the ion current in the fuel injection control. Accordingly, it is possible to finely control operating conditions of the engine.

Figure 9:
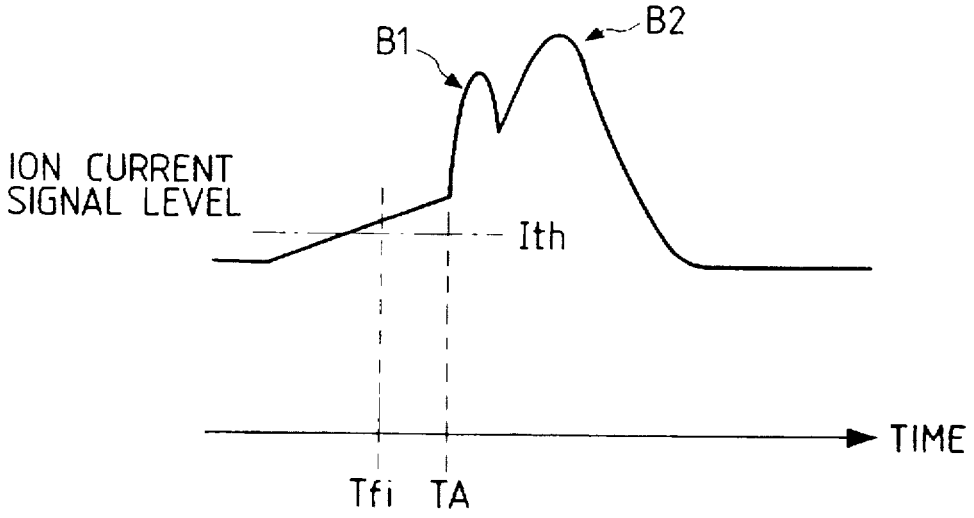
FIG. 9 is a time-domain diagram of an ion-current signal level which occurs under conditions where carbon is on an ion sensing electrode.

In some cases, carbon (soot) caused by the burning of an air-fuel mixture adheres to a surface of the ion sensing electrode 3 of the glow plug 1. In these cases, as shown in FIG. 9, the ion-current signal level continues to rise at a low rate during a time interval before and at the fuel injection moment Tfi. The ion-current signal levels which occur at and before the fuel injection moment Tfi represent the amount of carbon (soot) on the surface of the ion sensing electrode 3. If the ion-current signal level reaches a threshold value Ith at or before the fuel injection moment Tfi, the ECU 52 changes the relays 53 and 531 to their on positions. As a result, the heating member 2 is activated, and the ion sensing electrode 3 is heated by the heating member 2. This heating process burns the carbon (the soot) away from the surface of the ion sensing electrode 3. Thus, the ion sensing electrode 3 returns to its normal state.

Figure 10:
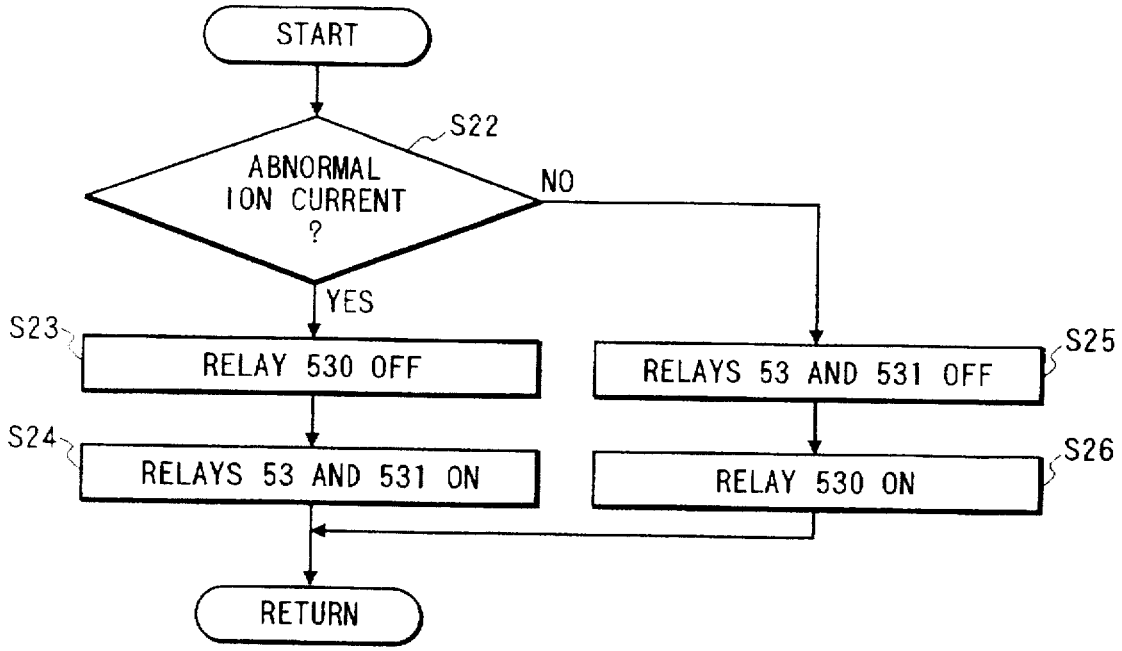
FIG. 10 is a flowchart of a segment of the program related to operation of the electronic control unit (ECU) in FIG. 6.

FIG. 10 is a flowchart of a segment (a sub routine) of the program for the ECU 52 which relates to a process of burning carbon (soot) away from a surface of the ion sensing electrode 3 of the glow plug 1. The program segment in FIG. 10 is iteratively executed in synchronism with, for example, a fuel injection timing.

With reference to FIG. 10, a first step S22 of the program segment derives information of an ion current from the output signal of the potentiometer 522 at a fuel injection moment Tfi. The step S22 compares the ion current with a threshold value Ith to decide whether an abnormal ion current is present or absent. When the ion current is greater than the threshold value Ith, that is, when an abnormal ion current is present, the program advances from the step S22 to a step S23. Otherwise, the program advances from the step S22 to a step S25.

The step S23 changes the relay 530 to its off position. A step S24 following the step S23 changes the relays 53 and 531 to their on positions. Therefore, the heating member 2 is activated so that the carbon (the soot) can be burned away from the surface of the ion sensing electrode 3. After the step S24, the current execution cycle of the program segment ends and the program returns to the main routine.

The step S25 sets the relays 53 and 531 to their off positions. A step S26 following the step S25 sets the relay 530 to its on position. After the step S26, the current execution cycle of the program segment ends and the program returns to the main routine.

With reference back to FIG. 3, the electric resistance R2 of the second region 202 of the heating member 2 is smaller than the electric resistance "r" of the ion sensing electrode 3 as previously explained. Therefore, a greater portion of a heating electric current, which has entered the heating member 2 via the positive end 218 thereof, is directed from the first region 201 to the second region 202 of the heating member 2. Thus, the first region 201 and the second region 202 of the heating member 2 are effectively activated and heated, and thereby the insulating member 11 and the ion sensing electrode 3 are also heated. Carbon (soot) on outer surfaces of the insulating member 11 and the ion sensing electrode 3 is oxidized by air in the swirl chamber 451 (see FIG. 6) and is burned away from the outer surfaces of the insulating member 11 and the ion sensing electrode 3 as the insulating member 11 and the ion sensing electrode 3 are heated. As a result, the glow plug 1 and the ion sensing electrode 3 therein return to their normal states. Thereafter, the relays 53 and 531 are changed to their off positions while the relay 530 is changed to its on position to detect an ion current again.

In the glow plug 1, the insulating member 11 contains the heating member 2, the lead wires 21 and 22, and a major part of the ion sensing electrode 3. The insulating member 11, the heating member 2, the lead wires 21 and 22, and the ion sensing electrode 3 are combined into a single unit. The glow plug 1 can be used in both a heating process and an ion-current detecting process. The heating process employs the heating member 2 while the ion-current detecting process employs the ion sensing electrode 3. The glow plug 1 is relatively compact as a glow plug usable in both a heating process and an ion-current detecting process.

When carbon (soot) adheres to the outer surfaces of the ion sensing electrode 3 and the insulating member 11, the ECU 52 operates to make an electric current to flow through the first region 201 and the second region 202 of the heating member 2 as previously explained. Thus, in this case, the first region 201 and the second region 202 of the heating member 2 are heated, and thereby the insulating member 11 and the ion sensing electrode 3 are also heated so that the carbon (the soot) is burned away from the outer surfaces of the ion sensing electrode 3 and the insulating member 11. As a result, the ion sensing electrode 3 is returned to its normal state at which the ion sensing electrode 3 can accurately detect an ion current.

The heating member 2, the lead wires 21 and 22, and the ion sensing electrode 3 are provided in the insulating member 11. The ion sensing electrode 3 has a coating of platinum. Therefore, it is possible to prevent the heating member 2, the lead wires 21 and 22, and the ion sensing electrode 3 from being oxidized and corroded by the burning of an air-fuel mixture. Thus, the heating member 2, the lead wires 21 and 22, and the ion sensing electrode 3 have good durabilities.

The tip (the lower end) of the insulating member 11 is hemispherical. The hemispherical shape less adversely affects a flow of the burning flame in the combustion chamber. Thus, the detection of an ion current is stable. In addition, the hemispherical shape suppresses the concentration of thermal stress, and hence enables a thermal shock to be effectively absorbed.

As previously explained, the tip (the lower end) 30 of the ion sensing electrode 3 has a coating of platinum (Pt). The Pt coating prevents a surface portion of the ion sensing electrode 3 from being oxidized into insulating substance. Therefore, the electrical conductivity or the electric resistance of the ion sensing electrode 3 can be maintained at its original value for a long term. Furthermore, the accuracy of detection of an ion current is prevented from decreasing.

It is preferable that the insulating member 11 has a cylindrical shape. Also, it is preferable that the ion sensing electrode 3 is centered at the axis of the insulating member 11. In this case, an ion current in any direction in the combustion chamber can be accurately detected.

Second Specific Embodiment

A second specific embodiment of this invention is similar to the first specific embodiment thereof except for design changes explained hereinafter.

With reference to FIG. 11, samples "1", "2", "3", "4", "5", and "6" of the glow plug 1 were made. The samples "1" to "6" were different from each other in the ratio between the electric resistances R2 and "r". Specifically, the electric resistance R2 in the sample "1" was equal to 0.4 Ω while the electric resistance "r" therein was equal to 1.0 Ω. The electric resistance R2 in the sample "2" was equal to 0.4 Ω while the electric resistance "r" therein was equal to 0.8 Ω. The electric resistance R2 in the sample "3" was equal to 0.4 Ω while the electric resistance "r" therein was equal to 0.6 Ω. The electric resistance R2 in the sample "4" was equal to 0.4 Ω while the electric resistance "r" therein was equal to 0.5 Ω. The electric resistance R2 in the sample "5" was equal to 0.4 Ω while the electric resistance "r" therein was equal to 0.4 Ω. The electric resistance R2 in the sample "6" was equal to 0.4 Ω while the electric resistance "r" therein was equal to 0.2 Ω.

A way of making each of the samples "1" to "6" of the glow plug 1 was as follows. A U-shaped molded member 29 for the heating member 2 and the ion sensing electrode 3 was made by injection molding. The lead wires 21 and 22 were connected to the U-shaped molded member 29. First and second semicylinders were prepared as halves for the insulating member 11. The first and second semicylinders had grooves for accommodating the U-shaped molded member 29. The U-shaped molded member 29 was placed into the groove in first semicylinder, and then the second semicylinder was placed on the first semicylinder and the U-shaped molded member 29 to form a cylindrical configuration. The combination of the first and second semicylinders and the U-shaped molded member 29 was pressurized and sintered (fired). As a result, the insulating member 11 was made which contained the heating member 2 and the ion sensing electrode 3.

Materials for the heating member 2 used a mixture of 40% $MoSi_2$ powder and 60% $Si_3N_4$ powder. The $MoSi_2$ powder was of electrically conductive ceramic. The $Si_3N_4$ powder was of insulating ceramic. The mean grain diameter of the $MoSi_2$ powder was equal to 1 μm. The mean grain diameter of the $Si_3N_4$ powder was equal to 8 μm. Furthermore, 10% sintering assistant was added to the mixture of the $MoSi_2$ powder and the $Si_3N_4$ powder by weight. The sintering assistant was made of $Y_2O_3$ and $Al_2O_3$.

Materials for the ion sensing electrode 3 used a mixture of $MoSi_2$ powder and $Si_3N_4$ powder. The $MoSi_2$ powder was of electrically conductive ceramic. The $Si_3N_4$ powder was of insulating ceramic. For the samples "1" to "6", the mixing weight ratios between the $MoSi_2$ powder and the $Si_3N_4$ powder were different to provide varying electric resistances "r". The mean grain diameter of the $MoSi_2$ powder was equal to 1 μm. The mean grain diameter of the $Si_3N_4$ powder was equal to 8 μm. Furthermore, 10% sintering assistant was added to the mixture of the $MoSi_2$ powder and the $Si_3N_4$ powder by weight. The sintering assistant was made of $Y_2O_3$ and $Al_2O_3$.

Materials for the insulating member 11 used a mixture of 30% $MoSi_2$ powder and 70% $Si_3N_4$ powder. The $MoSi_2$ powder was of electrically conductive ceramic. The $Si_3N_4$ powder was of insulating ceramic. The mean grain diameter of the $MoSi_2$ powder was equal to 1 μm. The mean grain diameter of the $Si_3N_4$ powder was equal to 1 μm. Furthermore, 10% sintering assistant was added to the mixture of the $MoSi_2$ powder and the $Si_3N_4$ powder by weight. The sintering assistant was made of $Y_2O_3$ and $Al_2O_3$.

The pressure sintering continued to be executed for 60 minutes. Conditions of the pressure sintering were as follows. The applied pressure was equal to 500 kg/cm$^2$. The sintering temperature (the firing temperature) was equal to 1,800° C.

As a result of the pressure sintering, the insulating member 11 was made which contained the heating member 2 and the ion sensing electrode 3. The insulating member 11 and other members were assembled into each of the samples "1" to "6" of the glow plug 1.

Experiments were performed on the samples "1" to "6" of the glow plug 1. During the experiments, each of the samples "1" to "6" was attached to the cylinder head 45. As shown in FIG. 3, a film of carbon 49 which had a predetermined thickness was deposited on outer surfaces of the ion sensing electrode 3 and the insulating member 11 in each of the samples "1" to "6". The film of carbon 49 had an electric resistance of 0.2 μ. Then, the heating member 2 was activated by closing the switch of the relay 530 (see FIG. 6) to implement a heating process to burn the carbon 49 away from the outer surfaces of the ion sensing electrode 3 and the insulating member 11. For each of the samples "1" to "6", measurement was given of the degree of the removal of the carbon 49 from the outer surfaces of the ion sensing electrode 3 and the insulating member 11. As shown in FIG. 11, the samples "1", "2", and "3" were excellent in the removal of carbon. The sample "4" was good in the removal of carbon. The samples "5" and "6" were poor in the removal of carbon.

Accordingly, it is preferable that the electric resistance R2 of the second region 202 of the heating member 2 is smaller than the electric resistance "r" of the ion sensing electrode 3 between its tip (its lower end) 30 and the junction 39 with the heating member 2.

In the case where the electric resistance R2 is equal to or greater than the electric resistance "r", a greater portion of a heating electric current, which has entered the heating member 2 via the positive end 218 thereof, leaks toward the ion sensing electrode 3 and the film of carbon 49. Thus, in this case, the second region 202 of the heating member 2 is less effectively heated, and the carbon 49 is less burned away from the outer surfaces of the ion sensing electrode 3 and the insulating member 11.

Third Specific Embodiment

A third specific embodiment of this invention is similar to the first and second specific embodiments thereof except for design changes explained hereinafter.

With reference to FIGS. 12, 13, and 14, samples "7" to "49" of the glow plug 1 were made. During the fabrication of the sample "7", materials for the heating member 2 used a mixture of WC powder and $Si_3N_4$ powder. The WC powder was of electrically conductive ceramic. The $Si_3N_4$ powder was of insulating ceramic. The mixing weight ratio between the WC powder and the $Si_3N_4$ powder was chosen to provide an electric resistance R2 of 0.4 Ω. The mean grain diameter of the WC powder was in the range of 1 μm to 3 μm. During the fabrication of the sample "7", materials for the ion sensing electrode 3 used a mixture of WC powder and $Si_3N_4$ powder. The WC powder was of electrically conductive ceramic. The $Si_3N_4$ powder was of insulating ceramic. The mixing weight ratio between the WC powder and the $Si_3N_4$ powder was chosen to provide an electric resistance "r" of 0.6 Ω as in the sample "3" in FIG. 11. The mean grain diameter of the WC powder was in the range of 1 μm to 3 μm.

A comparative sample for the sample "7" was also made. The comparative sample was similar to the sample "7" except that the mixing weight ratio between the WC powder and the $Si_3N_4$ powder in the materials for the ion sensing electrode 3 was chosen to provide an electric resistance "r" of 0.2 Ω as in the sample "6" in FIG. 11.

During the fabrication of the sample "8", materials for the heating member 2 used a mixture of $Mo_2C$ powder and $Si_3N_4$ powder. The $Mo_2C$ powder was of electrically conductive ceramic. The $Si_3N_4$ powder was of insulating ceramic. The mixing weight ratio between the $Mo_2C$ powder and the $Si_3N_4$ powder was chosen to provide an electric resistance R2 of 0.4 Ω. The mean grain diameter of the $Mo_2C$ powder was in the range of 1 μm to 3 μm. During the fabrication of the sample "8", materials for the ion sensing electrode 3 used a mixture of $Mo_2C$ powder and $Si_3N_4$ powder. The $Mo_2C$ powder was of electrically conductive ceramic. The $Si_3N_4$ powder was of insulating ceramic. The mixing weight ratio between the $Mo_2C$ powder and the $Si_3N_4$ powder was chosen to provide an electric resistance "r" of 0.6 Ω as in the sample "3" in FIG. 11. The mean grain diameter of the $Mo_2C$ powder was in the range of 1 μm to 3 μm.

A comparative sample for the sample "8" was also made. The comparative sample was similar to the sample "8" except that the mixing weight ratio between the $Mo_2C$ powder and the $Si_3N_4$ powder in the materials for the ion sensing electrode 3 was chosen to provide an electric resistance "r" of 0.2 Ω as in the sample "6" in FIG. 11.

During the fabrication of the sample "9", materials for the heating member 2 used a mixture of TiN powder and $Si_3N_4$ powder. The TiN powder was of electrically conductive ceramic. The $Si_3N_4$ powder was of insulating ceramic. The mixing weight ratio between the TiN powder and the $Si_3N_4$ powder was chosen to provide an electric resistance R2 of 0.4 Ω. The mean grain diameter of the TiN powder was in the range of 1 μm to 3 μm. During the fabrication of the sample "9", materials for the ion sensing electrode 3 used a mixture of TiN powder and $Si_3N_4$ powder. The TiN powder was of electrically conductive ceramic. The $Si_3N_4$ powder was of insulating ceramic. The mixing weight ratio between the TiN powder and the $Si_3N_4$ powder was chosen to provide an electric resistance "r" of 0.6 μ as in the sample "3" in FIG. 11. The mean grain diameter of the TiN powder was in the range of 1 μm to 3 μm.

A comparative sample for the sample "9" was also made. The comparative sample was similar to the sample "9" except that the mixing weight ratio between the TiN powder and the $Si_3N_4$ powder in the materials for the ion sensing electrode 3 was chosen to provide an electric resistance "r" of 0.2 Ω as in the sample "6" in FIG. 11.

During the fabrication of the sample "10", materials for the heating member 2 used a mixture of $WSi_2$ powder and $Si_3N_4$ powder. The $WSi_2$ powder was of electrically conductive ceramic. The $Si_3N_4$ powder was of insulating ceramic. The mixing weight ratio between the $WSi_2$ powder and the $Si_3N_4$ powder was chosen to provide an electric resistance R2 of 0.4 Ω. The mean grain diameter of the $WSi_2$ powder was in the range of 1 μm to 3 μm. During the fabrication of the sample "10", materials for the ion sensing electrode 3 used a mixture of $WSi_2$ powder and $Si_3N_4$ powder. The $WSi_2$ powder was of electrically conductive ceramic. The $Si_3N_4$ powder was of insulating ceramic. The mixing weight ratio between the $WSi_2$ powder and the $Si_3N_4$ powder was chosen to provide an electric resistance "r" of 0.6 Ω as in the sample "3" in FIG. 11. The mean grain diameter of the $WSi_2$ powder was in the range of 1 μm to 3 μm.

A comparative sample for the sample "10" was also made. The comparative sample was similar to the sample "10" except that the mixing weight ratio between the $WSi_2$ powder and the $Si_3N_4$ powder in the materials for the ion sensing electrode 3 was chosen to provide an electric resistance "r" of 0.2 Ω as in the sample "6" in FIG. 11.

During the fabrication of the sample "11", materials for the heating member 2 used a mixture of $Mo_{4.8}Si_3C_{0.6}$ powder and $Si_3N_4$ powder. The $Mo_{4.8}Si_3C_{0.6}$ powder was of electrically conductive ceramic. The $Si_3N_4$ powder was of insulating ceramic. The mixing weight ratio between the $Mo_{4.8}Si_3C_{0.6}$ powder and the $Si_3N_4$ powder was chosen to provide an electric resistance R2 of 0.4 Ω. The mean grain diameter of the $Mo_{4.8}Si_3C_{0.6}$ powder was in the range of 1 μm to 3 μm. During the fabrication of the sample "11", materials for the ion sensing electrode 3 used a mixture of $Mo_{4.8}Si_3C_{0.6}$ powder and $Si_3N_4$ powder. The $Mo_{4.8}Si_3C_{0.6}$ powder was of electrically conductive ceramic. The $Si_3N_4$ powder was of insulating ceramic. The mixing weight ratio between the $Mo_{4.8}Si_3C_{0.6}$ powder and the $Si_3N_4$ powder was chosen to provide an electric resistance "r" of 0.6 Ω as in the sample "3" in FIG. 11. The mean grain diameter of the $Mo_{4.8}Si_3C_{0.6}$ powder was in the range of 1 μm to 3 μm.

A comparative sample for the sample "11" was also made. The comparative sample was similar to the sample "11" except that the mixing weight ratio between the $Mo_{4.8}Si_3C_{0.6}$ powder and the $Si_3N_4$ powder in the materials for the ion sensing electrode 3 was chosen to provide an electric resistance "r" of 0.2 Ω as in the sample "6" in FIG. 11.

During the fabrication of the sample "12", materials for the heating member 2 used a mixture of MoB powder and $Si_3N_4$ powder. The MoB powder was of electrically conductive ceramic. The $Si_3N_4$ powder was of insulating ceramic. The mixing weight ratio between the MoB powder and the $Si_3N_4$ powder was chosen to provide an electric resistance R2 of 0.4 Ω. The mean grain diameter of the MoB powder was in the range of 1 μm to 3 μm. During the fabrication of the sample "12", materials for the ion sensing electrode 3 used a mixture of MoB powder and $Si_3N_4$ powder. The MoB powder was of electrically conductive ceramic. The $Si_3N_4$ powder was of insulating ceramic. The mixing weight ratio between the MoB powder and the $Si_3N_4$ powder was chosen to provide an electric resistance "r" of 0.6 Ω as in the sample "3" in FIG. 11. The mean grain diameter of the MoB powder was in the range of 1 μm to 3 μm.

A comparative sample for the sample "12" was also made. The comparative sample was similar to the sample "12" except that the mixing weight ratio between the MoB powder and the $Si_3N_4$ powder in the materials for the ion sensing electrode 3 was chosen to provide an electric resistance "r" of 0.2 Ω as in the sample "6" in FIG. 11.

During the fabrication of the sample "13", materials for the heating member 2 used a mixture of $TiB_2$ powder and $Si_3N_4$ powder. The $TiB_2$ powder was of electrically conductive ceramic. The $Si_3N_4$ powder was of insulating ceramic. The mixing weight ratio between the $TiB_2$ powder and the $Si_3N_4$ powder was chosen to provide an electric resistance R2 of 0.4 Ω. The mean grain diameter of the $TiB_2$ powder was in the range of 1 μm to 3 μm. During the fabrication of the sample "13", materials for the ion sensing electrode 3 used a mixture of $TiB_2$ powder and $Si_3N_4$ powder. The $TiB_2$ powder was of electrically conductive ceramic. The $Si_3N_4$ powder was of insulating ceramic. The mixing weight ratio between the $TiB_2$ powder and the $Si_3N_4$ powder was chosen to provide an electric resistance "r" of 0.6 Ω as in the sample "3" in FIG. 11. The mean grain diameter of the $TiB_2$ powder was in the range of 1 μm to 3 μm.

A comparative sample for the sample "13" was also made. The comparative sample was similar to the sample "13" except that the mixing weight ratio between the $TiB_2$ powder and the $Si_3N_4$ powder in the materials for the ion sensing electrode 3 was chosen to provide an electric resistance "r" of 0.2 Ω as in the sample "6" in FIG. 11.

During the fabrication of the sample "14", materials for the heating member 2 used a mixture of $ZrB_2$ powder and $Si_3N_4$ powder. The $ZrB_2$ powder was of electrically conductive ceramic. The $Si_3N_4$ powder was of insulating ceramic. The mixing weight ratio between the $ZrB_2$ powder and the $Si_3N_4$ powder was chosen to provide an electric resistance R2 of 0.4 Ω. The mean grain diameter of the $ZrB_2$ powder was in the range of 1 μm to 3 μm. During the fabrication of the sample "14", materials for the ion sensing electrode 3 used a mixture of $ZrB_2$ powder and $Si_3N_4$ powder. The $ZrB_2$ powder was of electrically conductive ceramic. The $Si_3N_4$ powder was of insulating ceramic. The mixing weight ratio between the $ZrB_2$ powder and the $Si_3N_4$ powder was chosen to provide an electric resistance "r" of 0.6 Ω as in the sample "3" in FIG. 11. The mean grain diameter of the $ZrB_2$ powder was in the range of 1 μm to 3 μm.

A comparative sample for the sample "14" was also made. The comparative sample was similar to the sample "14" except that the mixing weight ratio between the $ZrB_2$ powder and the $Si_3N_4$ powder in the materials for the ion sensing electrode 3 was chosen to provide an electric resistance "r" of 0.2 Ω as in the sample "6" in FIG. 11.

During the fabrication of the sample "15", materials for the heating member 2 used a mixture of WC powder and $Si_3N_4$ powder. The WC powder was of electrically conductive ceramic. The $Si_3N_4$ powder was of insulating ceramic. The mixing weight ratio between the WC powder and the $Si_3N_4$ powder was chosen to provide an electric resistance R2 of 0.4 Ω. The mean grain diameter of the WC powder was in the range of 1 μm to 3 μm. During the fabrication of the sample "15", materials for the ion sensing electrode 3 used a mixture of $MoSi_2$ powder and $Si_3N_4$ powder. The $MoSi_2$ powder was of electrically conductive ceramic. The $Si_3N_4$ powder was of insulating ceramic. The mixing weight ratio between the $MoSi_2$ powder and the $Si_3N_4$ powder was chosen to provide an electric resistance "r" of 0.6 Ω as in the sample "3" in FIG. 11. The mean grain diameter of the $MoSi_2$ powder was in the range of 1 μm to 3 μm.

A comparative sample for the sample "15" was also made. The comparative sample was similar to the sample "15" except that the mixing weight ratio between the $MoSi_2$ powder and the $Si_3N_4$ powder in the materials for the ion sensing electrode 3 was chosen to provide an electric resistance "r" of 0.2 Ω as in the sample "6" in FIG. 11.

During the fabrication of the sample "16", materials for the heating member 2 used a mixture of $Mo_2C$ powder and $Si_3N_4$ powder. The $Mo_2C$ powder was of electrically conductive ceramic.

The $Si_3N_4$ powder was of insulating ceramic. The mixing weight ratio between the $Mo_2C$ powder and the $Si_3N_4$ powder was chosen to provide an electric resistance R2 of 0.4 Ω. The mean grain diameter of the $Mo_2C$ powder was in the range of 1 μm to 3 μm. During the fabrication of the sample "16", materials for the ion sensing electrode 3 used a mixture of $MoSi_2$ powder and $Si_3N_4$ powder. The $MoSi_2$ powder was of electrically conductive ceramic. The $Si_3N_4$ powder was of insulating ceramic. The mixing weight ratio between the $MoSi_2$ powder and the $Si_3N_4$ powder was chosen to provide an electric resistance "r" of 0.6 Ω as in the sample "3" in FIG. 11. The mean grain diameter of the $MoSi_2$ powder was in the range of 1 μm to 3 μm.

A comparative sample for the sample "16" was also made. The comparative sample was similar to the sample "16" except that the mixing weight ratio between the $MoSi_2$ powder and the $Si_3N_4$ powder in the materials for the ion sensing electrode 3 was chosen to provide an electric resistance "r" of 0.2 Ω as in the sample "6" in FIG. 11.

During the fabrication of the sample "17", materials for the heating member 2 used a mixture of TiN powder and $Si_3N_4$ powder. The TiN powder was of electrically conductive ceramic. The $Si_3N_4$ powder was of insulating ceramic. The mixing weight ratio between the TiN powder and the $Si_3N_4$ powder was chosen to provide an electric resistance R2 of 0.4 Ω. The mean grain diameter of the TiN powder was in the range of 1 μm to 3 μm.

During the fabrication of the sample "17", materials for the ion sensing electrode 3 used a mixture of $MoSi_2$ powder and $Si_3N_4$ powder. The $MoSi_2$ powder was of electrically conductive ceramic. The $Si_3N_4$ powder was of insulating ceramic. The mixing weight ratio between the $MoSi_2$ powder and the $Si_3N_4$ powder was chosen to provide an electric resistance "r" of 0.6 Ω as in the sample "3" in FIG. 11. The mean grain diameter of the $MoSi_2$ powder was in the range of 1 μm to 3 μm.

A comparative sample for the sample "17" was also made. The comparative sample was similar to the sample "17" except that the mixing weight ratio between the $MoSi_2$ powder and the $Si_3N_4$ powder in the materials for the ion sensing electrode 3 was chosen to provide an electric resistance "r" of 0.2 Ω as in the sample "6" in FIG. 11.

During the fabrication of the sample "18", materials for the heating member 2 used a mixture of $WSi_2$ powder and $Si_3N_4$ powder. The $WSi_2$ powder was of electrically conductive ceramic. The $Si_3N_4$ powder was of insulating ceramic. The mixing weight ratio between the $WSi_2$ powder and the $Si_3N_4$ powder was chosen to provide an electric resistance R2 of 0.4 Ω. The mean grain diameter of the $WSi_2$ powder was in the range of 1 μm to 3 μm. During the fabrication of the sample "18", materials for the ion sensing electrode 3 used a mixture of $MoSi_2$ powder and $Si_3N_4$ powder. The $MoSi_2$ powder was of electrically conductive ceramic. The $Si_3N_4$ powder was of insulating ceramic. The mixing weight ratio between the $MoSi_2$ powder and the $Si_3N_4$ powder was chosen to provide an electric resistance "r" of 0.6 Ω as in the sample "3" in FIG. 11. The mean grain diameter of the $MoSi_2$ powder was in the range of 1 μm to 3 μm.

A comparative sample for the sample "18" was also made. The comparative sample was similar to the sample "18" except that the mixing weight ratio between the $MoSi_2$ powder and the $Si_3N_4$ powder in the materials for the ion sensing electrode 3 was chosen to provide an electric resistance "r" of 0.2 Ω as in the sample "6" in FIG. 11.

During the fabrication of the sample "19", materials for the heating member 2 used a mixture of $Mo_{4.8}Si_3C_{0.6}$ powder and $Si_3N_4$ powder. The $Mo_{4.8}Si_3C_{0.6}$ powder was of electrically conductive ceramic. The $Si_3N_4$ powder was of insulating ceramic. The mixing weight ratio between the $Mo_{4.8}Si_3C_{0.6}$ powder and the $Si_3N_4$ powder was chosen to provide an electric resistance R2 of 0.4 Ω. The mean grain diameter of the $Mo_{4.8}Si_3C_{0.6}$ powder was in the range of 1 μm to 3 μm. During the fabrication of the sample "19", materials for the ion sensing electrode 3 used a mixture of $MoSi_2$ powder and $Si_3N_4$ powder. The $MoSi_2$ powder was of electrically conductive ceramic. The $Si_3N_4$ powder was of insulating ceramic. The mixing weight ratio between the $MoSi_2$ powder and the $Si_3N_4$ powder was chosen to provide an electric resistance "r" of 0.6 Ω as in the sample "3" in FIG. 11. The mean grain diameter of the $MoSi_2$ powder was in the range of 1 μm to 3 μm.

A comparative sample for the sample "19" was also made. The comparative sample was similar to the sample "19" except that the mixing weight ratio between the $MoSi_2$ powder and the $Si_3N_4$ powder in the materials for the ion sensing electrode 3 was chosen to provide an electric resistance "r" of 0.2 Ω as in the sample "6" in FIG. 11.

During the fabrication of the sample "20", materials for the heating member 2 used a mixture of MoB powder and $Si_3N_4$ powder. The MoB powder was of electrically conductive ceramic. The $Si_3N_4$ powder was of insulating ceramic. The mixing weight ratio between the MoB powder and the $Si_3N_4$ powder was chosen to provide an electric resistance R2 of 0.4 Ω. The mean grain diameter of the MoB powder was in the range of 1 μm to 3 μm. During the fabrication of the sample "20", materials for the ion sensing electrode 3 used a mixture of $MoSi_2$ powder and $Si_3N_4$ powder. The $MoSi_2$ powder was of electrically conductive ceramic. The $Si_3N_4$ powder was of insulating ceramic. The mixing weight ratio between the $MoSi_2$ powder and the $Si_3N_4$ powder was chosen to provide an electric resistance "r" of 0.6 Ω as in the sample "3" in FIG. 11. The mean grain diameter of the $MoSi_2$ powder was in the range of 1 μm to 3 μm.

A comparative sample for the sample "20" was also made. The comparative sample was similar to the sample "20" except that the mixing weight ratio between the $MoSi_2$ powder and the $Si_3N_4$ powder in the materials for the ion sensing electrode 3 was chosen to provide an electric resistance "r" of 0.2 μas in the sample "6" in FIG. 11.

During the fabrication of the sample "21", materials for the heating member 2 used a mixture of $TiB_2$ powder and $Si_3N_4$ powder. The $TiB_2$ powder was of electrically conductive ceramic. The $Si_3N_4$ powder was of insulating ceramic. The mixing weight ratio between the $TiB_2$ powder and the $Si_3N_4$ powder was chosen to provide an electric resistance R2 of 0.4 Ω. The mean grain diameter of the $TiB_2$ powder was in the range of 1 μm to 3 μm. During the fabrication of the sample "21", materials for the ion sensing electrode 3 used a mixture of $MoSi_2$ powder and $Si_3N_4$ powder. The $MoSi_2$ powder was of electrically conductive ceramic. The $Si_3N_4$ powder was of insulating ceramic. The mixing weight ratio between the $MoSi_2$ powder and the $Si_3N_4$ powder was chosen to provide an electric resistance "r" of 0.6 Ω as in the sample "3" in FIG. 11. The mean grain diameter of the $MoSi_2$ powder was in the range of 1 μm to 3 μm.

A comparative sample for the sample "21" was also made. The comparative sample was similar to the sample "21" except that the mixing weight ratio between the $MoSi_2$ powder and the $Si_3N_4$ powder in the materials for the ion sensing electrode 3 was chosen to provide an electric resistance "r" of 0.2 Ω as in the sample "6" in FIG. 11.

During the fabrication of the sample "22", materials for the heating member 2 used a mixture of $ZrB_2$ powder and $Si_3N_4$ powder. The $ZrB_2$ powder was of electrically conductive ceramic. The $Si_3N_4$ powder was of insulating ceramic. The mixing weight ratio between the $ZrB_2$ powder and the $Si_3N_4$ powder was chosen to provide an electric resistance R2 of 0.4 Ω. The mean grain diameter of the $ZrB_2$ powder was in the range of 1 μm to 3 μm. During the fabrication of the sample "22", materials for the ion sensing electrode 3 used a mixture of $MoSi_2$ powder and $Si_3N_4$ powder. The $MoSi_2$ powder was of electrically conductive ceramic. The $Si_3N_4$ powder was of insulating ceramic. The mixing weight ratio between the $MoSi_2$ powder and the $Si_3N_4$ powder was chosen to provide an electric resistance "r" of 0.6 Ω as in the sample "3" in FIG. 11. The mean grain diameter of the $MoSi_2$ powder was in the range of 1 μm to 3 μm.

A comparative sample for the sample "22" was also made. The comparative sample was similar to the sample "22" except that the mixing weight ratio between the $MoSi_2$ powder and the $Si_3N_4$ powder in the materials for the ion sensing electrode 3 was chosen to provide an electric resistance "r" of 0.2 Ω as in the sample "6" in FIG. 11.

During the fabrication of the sample "23", materials for the heating member 2 used a mixture of $Mo_2C$ powder and $Al_2O_3$ powder. The $Mo_2C$ powder was of electrically conductive ceramic. The $Al_2O_3$ powder was of insulating ceramic. The mixing weight ratio between the $Mo_2C$ powder and the $Al_2O_3$ powder was chosen to provide an electric resistance R2 of 0.4 Ω. The mean grain diameter of the $Mo_2C$ powder was in the range of 1 μm to 3 μm. The mean grain diameter of the $Al_2O_3$ powder was equal to 25 μm. During the fabrication of the sample "23", materials for the ion sensing electrode 3 used a mixture of $MoSi_2$ powder and $Al_2O_3$ powder. The $MoSi_2$ powder was of electrically conductive ceramic.

The $Al_2O_3$ powder was of insulating ceramic. The mixing weight ratio between the $MoSi_2$ powder and the $Al_2O_3$ powder was chosen to provide an electric resistance "r" of 0.6 Ω as in the sample "3" in FIG. 11. The mean grain diameter of the $MoSi_2$ powder was in the range of 1 μm to 3 μm. The mean grain diameter of the $Al_2O_3$ powder was equal to 25 μm.

A comparative sample for the sample "23" was also made. The comparative sample was similar to the sample "23" except that the mixing weight ratio between the $MoSi_2$ powder and the $Al_2O_3$ powder in the materials for the ion sensing electrode 3 was chosen to provide an electric resistance "r" of 0.2 Ω as in the sample "6" in FIG. 11.

During the fabrication of the sample "24", materials for the heating member 2 used a mixture of WC powder and $Al_2O_3$ powder. The WC powder was of electrically conductive ceramic. The $Al_2O_3$ powder was of insulating ceramic. The mixing weight ratio between the WC powder and the $Al_2O_3$ powder was chosen to provide an electric resistance R2 of 0.4 Ω. The mean grain diameter of the WC powder was in the range of 1 μm to 3 μm. The mean grain diameter of the $Al_2O_3$ powder was equal to 25 μm. During the fabrication of the sample "24", materials for the ion sensing electrode 3 used a mixture of WC powder and $Al_2O_3$ powder. The WC powder was of electrically conductive ceramic. The $Al_2O_3$ powder was of insulating ceramic. The mixing weight ratio between the WC powder and the $Al_2O_3$ powder was chosen to provide an electric resistance "r" of 0.6 Ω as in the sample "3" in FIG. 11. The mean grain diameter of the WC powder was in the range of 1 μm to 3 μm. The mean grain diameter of the $Al_2O_3$ powder was equal to 25 μm.

A comparative sample for the sample "24" was also made. The comparative sample was similar to the sample "24" except that the mixing weight ratio between the WC powder and the $Al_2O_3$ powder in the materials for the ion sensing electrode 3 was chosen to provide an electric resistance "r" of 0.2 Ω as in the sample "6" in FIG. 11.

During the fabrication of the sample "25", materials for the heating member 2 used a mixture of $Mo_2C$ powder and $Al_2O_3$ powder. The $Mo_2C$ powder was of electrically conductive ceramic. The $Al_2O_3$ powder was of insulating ceramic. The mixing weight ratio between the $Mo_2C$ powder and the $Al_2O_3$ powder was chosen to provide an electric resistance R2 of 0.4 Ω. The mean grain diameter of the $Mo_2C$ powder was in the range of 1 μm to 3 μm. The mean grain diameter of the $Al_2O_3$ powder was equal to 25 μm. During the fabrication of the sample "25", materials for the ion sensing electrode 3 used a mixture of $Mo_2C$ powder and $Al_2O_3$ powder. The $Mo_2C$ powder was of electrically conductive ceramic. The $Al_2O_3$ powder was of insulating ceramic. The mixing weight ratio between the $Mo_2C$ powder and the $Al_2O_3$ powder was chosen to provide an electric resistance "r" of 0.6 Ω as in the sample "3" in FIG. 11. The mean grain diameter of the $Mo_2C$ powder was in the range of 1 μm to 3 μm. The mean grain diameter of the $Al_2O_3$ powder was equal to 25 μm.

A comparative sample for the sample "25" was also made. The comparative sample was similar to the sample "25" except that the mixing weight ratio between the $Mo_2C$ powder and the $Al_2O_3$ powder in the materials for the ion sensing electrode 3 was chosen to provide an electric resistance "r" of 0.2 Ω as in the sample "6" in FIG. 11.

During the fabrication of the sample "26", materials for the heating member 2 used a mixture of TiN powder and $Al_2O_3$ powder. The TiN powder was of electrically conductive ceramic. The $Al_2O_3$ powder was of insulating ceramic. The mixing weight ratio between the TiN powder and the $Al_2O_3$ powder was chosen to provide an electric resistance R2 of 0.4 Ω. The mean grain diameter of the TiN powder was in the range of 1 μm to 3 μm. The mean grain diameter of the $Al_2O_3$ powder was equal to 25 μm. During the fabrication of the sample "26", materials for the ion sensing electrode 3 used a mixture of TiN powder and $Al_2O_3$ powder. The TiN powder was of electrically conductive ceramic. The $Al_2O_3$ powder was of insulating ceramic. The mixing weight ratio between the TiN powder and the $Al_2O_3$ powder was chosen to provide an electric resistance "r" of 0.6 Ω as in the sample "3" in FIG. 11. The mean grain diameter of the TiN powder was in the range of 1 μm to 3 μm. The mean grain diameter of the $Al_2O_3$ powder was equal to 25 μm.

A comparative sample for the sample "26" was also made. The comparative sample was similar to the sample "26" except that the mixing weight ratio between the TiN powder and the $Al_2O_3$ powder in the materials for the ion sensing electrode 3 was chosen to provide an electric resistance "r" of 0.2 Ω as in the sample "6" in FIG. 11.

During the fabrication of the sample "27", materials for the heating member 2 used a mixture of $WSi_2$ powder and $Al_2O_3$ powder. The $WSi_2$ powder was of electrically conductive ceramic. The $Al_2O_3$ powder was of insulating ceramic. The mixing weight ratio between the $WSi_2$ powder and the $Al_2O_3$ powder was chosen to provide an electric resistance R2 of 0.4 Ω. The mean grain diameter of the $WSi_2$ powder was in the range of 1 μm to 3 μm. The mean grain diameter of the $Al_2O_3$ powder was equal to 25 μm. During the fabrication of the sample "27", materials for the ion sensing electrode 3 used a mixture of $WSi_2$ powder and $Al_2O_3$ powder. The $WSi_2$ powder was of electrically conductive ceramic. The $Al_2O_3$ powder was of insulating ceramic. The mixing weight ratio between the $WSi_2$ powder and the $Al_2O_3$ powder was chosen to provide an electric resistance "r" of 0.6 Ω as in the sample "3" in FIG. 11. The mean grain diameter of the $WSi_2$ powder was in the range of 1 μm to 3 μm. The mean grain diameter of the $Al_2O_3$ powder was equal to 25 μm.

A comparative sample for the sample "27" was also made. The comparative sample was similar to the sample "27" except that the mixing weight ratio between the $WSi_2$ powder and the $Al_2O_3$ powder in the materials for the ion sensing electrode 3 was chosen to provide an electric resistance "r" of 0.2 Ω as in the sample "6" in FIG. 11.

During the fabrication of the sample "28", materials for the heating member 2 used a mixture of $Mo_{4.8}Si_3C_{0.6}$ powder and $Al_2O_3$ powder. The $Mo_{4.8}Si_3C_{0.6}$ powder was of electrically conductive ceramic. The $Al_2O_3$ powder was of insulating ceramic. The mixing weight ratio between the $Mo_{4.8}Si_3C_{0.6}$ powder and the $Al_2O_3$ powder was chosen to provide an electric resistance R2 of 0.4 Ω. The mean grain diameter of the $Mo_{4.8}Si_3C_{0.6}$ powder was in the range of 1 μm to 3 μm. The mean grain diameter of the $Al_2O_3$ powder was equal to 25 μm. During the fabrication of the sample "28", materials for the ion sensing electrode 3 used a mixture of $Mo_{4.8}Si_3C_{0.6}$ powder and $Al_2O_3$ powder. The $Mo_{4.8}Si_3C_{0.6}$ powder was of electrically conductive ceramic. The $Al_2O_3$ powder was of insulating ceramic. The mixing weight ratio between the $Mo_{4.8}Si_3C_{0.6}$ powder and the $Al_2O_3$ powder was chosen to provide an electric resistance "r" of 0.6 Ω as in the sample "3" in FIG. 11. The mean grain diameter of the $Mo_{4.8}Si_3C_{0.6}$ powder was in the range of 1 μm to 3 μm. The mean grain diameter of the $Al_2O_3$ powder was equal to 25 μm.

A comparative sample for the sample "28" was also made. The comparative sample was similar to the sample "28" except that the mixing weight ratio between the $Mo_{4.8}Si_3C_{0.6}$ powder and the $Al_2O_3$ powder in the materials for the ion sensing electrode 3 was chosen to provide an electric resistance "r" of 0.2 Ω as in the sample "6" in FIG. 11.

During the fabrication of the sample "29", materials for the heating member 2 used a mixture of MoB powder and $Al_2O_3$ powder. The MoB powder was of electrically conductive ceramic. The $Al_2O_3$ powder was of insulating ceramic. The mixing weight ratio between the MoB powder and the $Al_2O_3$ powder was chosen to provide an electric resistance R2 of 0.4 Ω. The mean grain diameter of the MoB powder was in the range of 1 μm to 3 μm. The mean grain diameter of the $Al_2O_3$ powder was equal to 25 μm. During the fabrication of the sample "29", materials for the ion sensing electrode 3 used a mixture of $MoSi_2$ powder and $Al_2O_3$ powder. The $MoSi_2$ powder was of electrically conductive ceramic. The $Al_2O_3$ powder was of insulating ceramic. The mixing weight ratio between the $MoSi_2$ powder and the $Al_2O_3$ powder was chosen to provide an electric resistance "r" of 0.6 Ω as in the sample "3" in FIG. 11. The mean grain diameter of the $MoSi_2$ powder was in the range of 1 μm to 3 μm. The mean grain diameter of the $Al_2O_3$ powder was equal to 25 μm.

A comparative sample for the sample "29" was also made. The comparative sample was similar to the sample "29" except that the mixing weight ratio between the $MoSi_2$ powder and the $Al_2O_3$ powder in the materials for the ion sensing electrode 3 was chosen to provide an electric resistance "r" of 0.2 Ω as in the sample "6" in FIG. 11.

During the fabrication of the sample "30", materials for the heating member 2 used a mixture of $TiB_2$ powder and $Al_2O_3$ powder. The $TiB_2$ powder was of electrically conductive ceramic. The $Al_2O_3$ powder was of insulating ceramic. The mixing weight ratio between the $TiB_2$ powder and the $Al_2O_3$ powder was chosen to provide an electric resistance R2 of 0.4 Ω. The mean grain diameter of the $TiB_2$ powder was in the range of 1 μm to 3 μm. The mean grain diameter of the $Al_2O_3$ powder was equal to 25 μm. During the fabrication of the sample "30", materials for the ion sensing electrode 3 used a mixture of $MoSi_2$ powder and $Al_2O_3$ powder. The $MoSi_2$ powder was of electrically conductive ceramic. The $Al_2O_3$ powder was of insulating ceramic. The mixing weight ratio between the $MoSi_2$ powder and the $Al_2O_3$ powder was chosen to provide an electric resistance "r" of 0.6 Ω as in the sample "3" in FIG. 11. The mean grain diameter of the $MoSi_2$ powder was in the range of 1 μm to 3 μm. The mean grain diameter of the $Al_2O_3$ powder was equal to 25 μm.

A comparative sample for the sample "30" was also made. The comparative sample was similar to the sample "30" except that the mixing weight ratio between the $MoSi_2$ powder and the $Al_2O_3$ powder in the materials for the ion sensing electrode 3 was chosen to provide an electric resistance "r" of 0.2 Ω as in the sample "6" in FIG. 11.

During the fabrication of the sample "31", materials for the heating member 2 used a mixture of $ZrB_2$ powder and $Al_2O_3$ powder. The $ZrB_2$ powder was of electrically conductive ceramic. The $Al_2O_3$ powder was of insulating ceramic. The mixing weight ratio between the $ZrB_2$ powder and the $Al_2O_3$ powder was chosen to provide an electric resistance R2 of 0.4 Ω. The mean grain diameter of the $ZrB_2$ powder was in the range of 1 μm to 3 μm. The mean grain diameter of the $Al_2O_3$ powder was equal to 25 μm. During the fabrication of the sample "31", materials for the ion sensing electrode 3 used a mixture of $MoSi_2$ powder and $Al_2O_3$ powder. The $MoSi_2$ powder was of electrically conductive ceramic. The $Al_2O_3$ powder was of insulating ceramic. The mixing weight ratio between the $MoSi_2$ powder and the $Al_2O_3$ powder was chosen to provide an electric resistance "r" of 0.6 Ω as in the sample "3" in FIG. 11. The mean grain diameter of the $MoSi_2$ powder was in the range of 1 μm to 3 μm. The mean grain diameter of the $Al_2O_3$ powder was equal to 25 μm.

A comparative sample for the sample "31" was also made. The comparative sample was similar to the sample "31" except that the mixing weight ratio between the $MoSi_2$ powder and the $Al_2O_3$ powder in the materials for the ion sensing electrode 3 was chosen to provide an electric resistance "r" of 0.2 Ω as in the sample "6" in FIG. 11.

During the fabrication of the sample "32", materials for the heating member 2 used a mixture of $MoSi_2$ powder and BN powder. The $MoSi_2$ powder was of electrically conductive ceramic. The BN powder was of insulating ceramic. The mixing weight ratio between the $MoSi_2$ powder and the BN powder was chosen to provide an electric resistance R2 of 0.4 Ω. The mean grain diameter of the $MoSi_2$ powder was in the range of 1 μm to 3 μm. The mean grain diameter of the BN powder was equal to 10 μm. During the fabrication of the sample "32", materials for the ion sensing electrode 3 used a mixture of $MoSi_2$ powder and BN powder. The $MoSi_2$ powder was of electrically conductive ceramic. The BN powder was of insulating ceramic. The mixing weight ratio between the $MoSi_2$ powder and the BN powder was chosen to provide an electric resistance "r" of 0.6 Ω as in the sample "3" in FIG. 11. The mean grain diameter of the $MoSi_2$ powder was in the range of 1 μm to 3 μm. The mean grain diameter of the BN powder was equal to 10 μm.

A comparative sample for the sample "32" was also made. The comparative sample was similar to the sample "32" except that the mixing weight ratio between the $MoSi_2$ powder and the BN powder in the materials for the ion sensing electrode 3 was chosen to provide an electric resistance "r" of 0.2 Ω as in the sample "6" in FIG. 11.

During the fabrication of the sample "33", materials for the heating member 2 used a mixture of WC powder and BN powder. The WC powder was of electrically conductive ceramic. The BN powder was of insulating ceramic. The mixing weight ratio between the WC powder and the BN powder was chosen to provide an electric resistance R2 of 0.4 Ω. The mean grain diameter of the WC powder was in the range of 1 μm to 3 μm. The mean grain diameter of the BN powder was equal to 10 μm. During the fabrication of the sample "33", materials for the ion sensing electrode 3 used a mixture of WC powder and BN powder. The WC powder was of electrically conductive ceramic. The BN powder was of insulating ceramic. The mixing weight ratio between the WC powder and the BN powder was chosen to provide an electric resistance "r" of 0.6 Ω as in the sample "3" in FIG. 11. The mean grain diameter of the WC powder was in the range of 1 μm to 3 μm. The mean grain diameter of the BN powder was equal to 10 μm.

A comparative sample for the sample "33" was also made. The comparative sample was similar to the sample "33" except that the mixing weight ratio between the WC powder and the BN powder in the materials for the ion sensing electrode 3 was chosen to provide an electric resistance "r" of 0.2 Ω as in the sample "6" in FIG. 11.

During the fabrication of the sample "34", materials for the heating member 2 used a mixture of $Mo_2C$ powder and BN powder. The $Mo_2C$ powder was of electrically conductive ceramic. The BN powder was of insulating ceramic. The mixing weight ratio between the $Mo_2C$ powder and the BN powder was chosen to provide an electric resistance R2 of 0.4 Ω. The mean grain diameter of the $Mo_2C$ powder was in the range of 1 μm to 3 μm. The mean grain diameter of the BN powder was equal to 10 μm. During the fabrication of the sample "34", materials for the ion sensing electrode 3 used a mixture of $Mo_2C$ powder and BN powder. The $Mo_2C$ powder was of electrically conductive ceramic. The BN powder was of insulating ceramic. The mixing weight ratio between the $Mo_2C$ powder and the BN powder was chosen to provide an electric resistance "r" of 0.6 Ω as in the sample "3" in FIG. 11. The mean grain diameter of the $Mo_2C$ powder was in the range of 1 μm to 3 μm. The mean grain diameter of the BN powder was equal to 10 μm.

A comparative sample for the sample "34" was also made. The comparative sample was similar to the sample "34"

except that the mixing weight ratio between the $Mo_2C$ powder and the BN powder in the materials for the ion sensing electrode 3 was chosen to provide an electric resistance "r" of 0.2 Ω as in the sample "6" in FIG. 11.

During the fabrication of the sample "35", materials for the heating member 2 used a mixture of TiN powder and BN powder. The TiN powder was of electrically conductive ceramic. The BN powder was of insulating ceramic. The mixing weight ratio between the TiN powder and the BN powder was chosen to provide an electric resistance R2 of 0.4 Ω. The mean grain diameter of the TiN powder was in the range of 1 μm to 3 μm. The mean grain diameter of the BN powder was equal to 10 μm. During the fabrication of the sample "35", materials for the ion sensing electrode 3 used a mixture of TiN powder and BN powder. The TiN powder was of electrically conductive ceramic. The BN powder was of insulating ceramic. The mixing weight ratio between the TiN powder and the BN powder was chosen to provide an electric resistance "r" of 0.6 Ω as in the sample "3" in FIG. 11. The mean grain diameter of the TiN powder was in the range of 1 μm to 3 μm. The mean grain diameter of the BN powder was equal to 10 μm.

A comparative sample for the sample "35" was also made. The comparative sample was similar to the sample "35" except that the mixing weight ratio between the TiN powder and the BN powder in the materials for the ion sensing electrode 3 was chosen to provide an electric resistance "r" of 0.2 Ω as in the sample "6" in FIG. 11.

During the fabrication of the sample "36", materials for the heating member 2 used a mixture of $WSi_2$ powder and BN powder. The $WSi_2$ powder was of electrically conductive ceramic. The BN powder was of insulating ceramic. The mixing weight ratio between the $WSi_2$ powder and the BN powder was chosen to provide an electric resistance R2 of 0.4 Ω. The mean grain diameter of the $WSi_2$ powder was in the range of 1 μm to 3 μm. The mean grain diameter of the BN powder was equal to 10 μm. During the fabrication of the sample "36", materials for the ion sensing electrode 3 used a mixture of $WSi_2$ powder and BN powder. The $WSi_2$ powder was of electrically conductive ceramic. The BN powder was of insulating ceramic. The mixing weight ratio between the $WSi_2$ powder and the BN powder was chosen to provide an electric resistance "r" of 0.6 Ω as in the sample "3" in FIG. 11. The mean grain diameter of the $WSi_2$ powder was in the range of 1 μm to 3 μm. The mean grain diameter of the BN powder was equal to 10 μm.

A comparative sample for the sample "36" was also made. The comparative sample was similar to the sample "36" except that the mixing weight ratio between the $WSi_2$ powder and the BN powder in the materials for the ion sensing electrode 3 was chosen to provide an electric resistance "r" of 0.2 Ω as in the sample "6" in FIG. 11.

During the fabrication of the sample "37", materials for the heating member 2 used a mixture of $Mo_{4.8}Si_3C_{0.6}$ powder and BN powder. The $Mo_{4.8}Si_3C_{0.6}$ powder was of electrically conductive ceramic. The BN powder was of insulating ceramic. The mixing weight ratio between the $Mo_{4.8}Si_3C_{0.6}$ powder and the BN powder was chosen to provide an electric resistance R2 of 0.4 Ω. The mean grain diameter of the $Mo_{4.8}Si_3C_{0.6}$ powder was in the range of 1 μm to 3 μm. The mean grain diameter of the BN powder was equal to 10 μm. During the fabrication of the sample "37", materials for the ion sensing electrode 3 used a mixture of $Mo_{4.8}Si_3C_{0.6}$ powder and BN powder. The $Mo_{4.8}Si_3C_{0.6}$ powder was of electrically conductive ceramic. The BN powder was of insulating ceramic. The mixing weight ratio between the $Mo_{4.8}Si_3C_{0.6}$ powder and the BN powder was chosen to provide an electric resistance "r" of 0.6 Ω as in the sample "3" in FIG. 11. The mean grain diameter of the $Mo_{4.8}Si_3C_{0.6}$ powder was in the range of 1 μm to 3 μm. The mean grain diameter of the BN powder was equal to 10 μm.

A comparative sample for the sample "37" was also made. The comparative sample was similar to the sample "37" except that the mixing weight ratio between the $Mo_{4.8}Si_3C_{0.6}$ powder and the BN powder in the materials for the ion sensing electrode 3 was chosen to provide an electric resistance "r" of 0.2 Ω as in the sample "6" in FIG. 11.

During the fabrication of the sample "38", materials for the heating member 2 used a mixture of MoB powder and BN powder. The MoB powder was of electrically conductive ceramic. The BN powder was of insulating ceramic. The mixing weight ratio between the MoB powder and the BN powder was chosen to provide an electric resistance R2 of 0.4 Ω. The mean grain diameter of the MoB powder was in the range of 1 μm to 3 μm. The mean grain diameter of the BN powder was equal to 10 μm. During the fabrication of the sample "38", materials for the ion sensing electrode 3 used a mixture of $MoSi_2$ powder and BN powder. The $MoSi_2$ powder was of electrically conductive ceramic. The BN powder was of insulating ceramic. The mixing weight ratio between the $MoSi_2$ powder and the BN powder was chosen to provide an electric resistance "r" of 0.6 Ω as in the sample "3" in FIG. 11. The mean grain diameter of the $MoSi_2$ powder was in the range of 1 μm to 3 μm. The mean grain diameter of the BN powder was equal to 10 μm.

A comparative sample for the sample "38" was also made. The comparative sample was similar to the sample "38" except that the mixing weight ratio between the $MoSi_2$ powder and the BN powder in the materials for the ion sensing electrode 3 was chosen to provide an electric resistance "r" of 0.2 Ω as in the sample "6" in FIG. 11.

During the fabrication of the sample "39", materials for the heating member 2 used a mixture of $TiB_2$ powder and BN powder. The $TiB_2$ powder was of electrically conductive ceramic. The BN powder was of insulating ceramic. The mixing weight ratio between the $TiB_2$ powder and the BN powder was chosen to provide an electric resistance R2 of 0.4 Ω. The mean grain diameter of the $TiB_2$ powder was in the range of 1 μm to 3 μm. The mean grain diameter of the BN powder was equal to 10 μm. During the fabrication of the sample "39", materials for the ion sensing electrode 3 used a mixture of $MoSi_2$ powder and BN powder. The $MoSi_2$ powder was of electrically conductive ceramic. The BN powder was of insulating ceramic. The mixing weight ratio between the $MoSi_2$ powder and the BN powder was chosen to provide an electric resistance "r" of 0.6 Ω as in the sample "3" in FIG. 11. The mean grain diameter of the $MoSi_2$ powder was in the range of 1 μm to 3 μm. The mean grain diameter of the BN powder was equal to 10 μm.

A comparative sample for the sample "39" was also made. The comparative sample was similar to the sample "39" except that the mixing weight ratio between the $MoSi_2$ powder and the BN powder in the materials for the ion sensing electrode 3 was chosen to provide an electric resistance "r" of 0.2 Ω as in the sample "6" in FIG. 11.

During the fabrication of the sample "40", materials for the heating member 2 used a mixture of $ZrB_2$ powder and BN powder. The $ZrB_2$ powder was of electrically conductive ceramic. The BN powder was of insulating ceramic. The mixing weight ratio between the $ZrB_2$ powder and the BN powder was chosen to provide an electric resistance R2 of 0.4 Ω. The mean grain diameter of the $ZrB_2$ powder was in the range of 1 μm to 3 μm. The mean grain diameter of the BN powder was equal to 10 μm. During the fabrication of the sample "40", materials for the ion sensing electrode 3 used a mixture of $MoSi_2$ powder and BN powder. The $MoSi_2$ powder was of electrically conductive ceramic. The BN powder was of insulating ceramic. The mixing weight ratio between the $MoSi_2$ powder and the BN powder was chosen to provide an electric resistance "r" of 0.6 Ω as in the sample "3" in FIG. 11. The mean grain diameter of the $MoSi_2$ powder was in the range of 1 μm to 3 μm. The mean grain diameter of the BN powder was equal to 10 μm.

A comparative sample for the sample "40" was also made. The comparative sample was similar to the sample "40" except that the mixing weight ratio between the $MoSi_2$ powder and the BN powder in the materials for the ion sensing electrode 3 was chosen to provide an electric resistance "r" of 0.2 Ω as in the sample "6" in FIG. 11.

During the fabrication of the sample "41", materials for the heating member 2 used WC powder of electrically conductive ceramic. The materials for the heating member 2 did not use insulating ceramic. The materials for the heating member 2 were designed to provide an electric resistance R2 of 0.4 Ω. The mean grain diameter of the WC powder was in the range of 1 μm to 3 μm. During the fabrication of the sample "41", materials for the ion sensing electrode 3 used WC powder of electrically conductive ceramic. The materials for the ion sensing electrode 3 did not use insulating ceramic. The materials for the ion sensing electrode 3 were designed to provide an electric resistance "r" of 0.6 Ω as in the sample "3" in FIG. 11. The mean grain diameter of the WC powder was in the range of 1 μm to 3 μm.

A comparative sample for the sample "41" was also made. The comparative sample was similar to the sample "41" except that the materials for the ion sensing electrode 3 were designed to provide an electric resistance "r" of 0.2 Ω as in the sample "6" in FIG. 11.

During the fabrication of the sample "42", materials for the heating member 2 used $Mo_2C$ powder of electrically conductive ceramic. The materials for the heating member 2 did not use insulating ceramic. The materials for the heating member 2 were designed to provide an electric resistance R2 of 0.4 Ω. The mean grain diameter of the $Mo_2C$ powder was in the range of 1 μm to 3 μm. During the fabrication of the sample "42", materials for the ion sensing electrode 3 used $Mo_2C$ powder of electrically conductive ceramic. The materials for the ion sensing electrode 3 did not use insulating ceramic. The materials for the ion sensing electrode 3 were designed to provide an electric resistance "r" of 0.6 Ω as in the sample "3" in FIG. 11. The mean grain diameter of the $Mo_2C$ powder was in the range of 1 μm to 3 μm.

A comparative sample for the sample "42" was also made. The comparative sample was similar to the sample "42" except that the materials for the ion sensing electrode 3 were designed to provide an electric resistance "r" of 0.2 Ω as in the sample "6" in FIG. 11.

During the fabrication of the sample "43", materials for the heating member 2 used TiN powder of electrically conductive ceramic. The materials for the heating member 2 did not use insulating ceramic. The materials for the heating member 2 were designed to provide an electric resistance R2 of 0.4 Ω. The mean grain diameter of the TiN powder was in the range of 1 μm to 3 μm. During the fabrication of the sample "43", materials for the ion sensing electrode 3 used TiN powder of electrically conductive ceramic. The materials for the ion sensing electrode 3 did not use insulating ceramic. The materials for the ion sensing electrode 3 were designed to provide an electric resistance "r" of 0.6 Ω as in the sample "3" in FIG. 11. The mean grain diameter of the TiN powder was in the range of 1 μm to 3 μm.

A comparative sample for the sample "43" was also made. The comparative sample was similar to the sample "43" except that the materials for the ion sensing electrode 3 were designed to provide an electric resistance "r" of 0.2 Ω as in the sample "6" in FIG. 11.

During the fabrication of the sample "44", materials for the heating member 2 used $WSi_2$ powder of electrically conductive ceramic. The materials for the heating member 2 did not use insulating ceramic. The materials for the heating member 2 were designed to provide an electric resistance R2 of 0.4 Ω. The mean grain diameter of the $WSi_2$ powder was in the range of 1 μm to 3 μm. During the fabrication of the sample "44", materials for the ion sensing electrode 3 used $WSi_2$ powder of electrically conductive ceramic. The materials for the ion sensing electrode 3 did not use insulating ceramic. The materials for the ion sensing electrode 3 were designed to provide an electric resistance "r" of 0.6 Ω as in the sample "3" in FIG. 11. The mean grain diameter of the $WSi_2$ powder was in the range of 1 μm to 3 μm.

A comparative sample for the sample "44" was also made. The comparative sample was similar to the sample "44" except that the materials for the ion sensing electrode 3 were designed to provide an electric resistance "r" of 0.2 Ω as in the sample "6" in FIG. 11.

During the fabrication of the sample "45", materials for the heating member 2 used $Mo_{4.8}Si_3C_{0.6}$ powder of electrically conductive ceramic. The materials for the heating member 2 did not use insulating ceramic. The materials for the heating member 2 were designed to provide an electric resistance R2 of 0.4 Ω. The mean grain diameter of the $Mo_{4.8}Si_3C_{0.6}$ powder was in the range of 1 μm to 3 μm. During the fabrication of the sample "45", materials for the ion sensing electrode 3 used $Mo_{4.8}Si_3C_{0.6}$ powder of electrically conductive ceramic. The materials for the ion sensing electrode 3 did not use insulating ceramic. The materials for the ion sensing electrode 3 were designed to provide an electric resistance "r" of 0.6 Ω as in the sample "3" in FIG. 11. The mean grain diameter of the $Mo_{4.8}Si_3C_{0.6}$ powder was in the range of 1 μm to 3 μm.

A comparative sample for the sample "45" was also made. The comparative sample was similar to the sample "45" except that the materials for the ion sensing electrode 3 were designed to provide an electric resistance "r" of 0.2 Ω as in the sample "6" in FIG. 11.

During the fabrication of the sample "46", materials for the heating member 2 used MoB powder of electrically conductive ceramic. The materials for the heating member 2 did not use insulating ceramic. The materials for the heating member 2 were designed to provide an electric resistance R2 of 0.4 Ω. The mean grain diameter of the MoB powder was in the range of 1 μm to 3 μm. During the fabrication of the sample "46", materials for the ion sensing electrode 3 used MoB powder of electrically conductive ceramic. The materials for the ion sensing electrode 3 did not use insulating ceramic. The materials for the ion sensing electrode 3 were designed to provide an electric resistance "r" of 0.6 Ω as in the sample "3" in FIG. 11. The mean grain diameter of the MoB powder was in the range of 1 μm to 3 μm.

A comparative sample for the sample "46" was also made. The comparative sample was similar to the sample "46" except that the materials for the ion sensing electrode 3 were designed to provide an electric resistance "r" of 0.2 Ω as in the sample "6" in FIG. 11.

During the fabrication of the sample "47", materials for the heating member 2 used $TiB_2$ powder of electrically conductive ceramic. The materials for the heating member 2 did not use insulating ceramic. The materials for the heating member 2 were designed to provide an electric resistance R2 of 0.4 Ω. The mean grain diameter of the $TiB_2$ powder was in the range of 1 μm to 3 μm. During the fabrication of the sample "47", materials for the ion sensing electrode 3 used $TiB_2$ powder of electrically conductive ceramic. The materials for the ion sensing electrode 3 did not use insulating ceramic. The materials for the ion sensing electrode 3 were designed to provide an electric resistance "r" of 0.6 Ω as in the sample "3" in FIG. 11. The mean grain diameter of the $TiB_2$ powder was in the range of 1 μm to 3 μm.

A comparative sample for the sample "47" was also made. The comparative sample was similar to the sample "47" except that the materials for the ion sensing electrode 3 were designed to provide an electric resistance "r" of 0.2 Ω as in the sample "6" in FIG. 11.

During the fabrication of the sample "48", materials for the heating member 2 used $ZrB_2$ powder of electrically conductive ceramic. The materials for the heating member 2 did not use insulating ceramic. The materials for the heating member 2 were designed to provide an electric resistance R2 of 0.4 Ω. The mean grain diameter of the $ZrB_2$ powder was in the range of 1 μm to 3 μm. During the fabrication of the sample "48", materials for the ion sensing electrode 3 used $ZrB_2$ powder of electrically conductive ceramic. The materials for the ion sensing electrode 3 did not use insulating ceramic. The materials for the ion sensing electrode 3 were designed to provide an electric resistance "r" of 0.6 Ω as in the sample "3" in FIG. 11. The mean grain diameter of the $ZrB_2$ powder was in the range of 1 μm to 3 μm.

A comparative sample for the sample "48" was also made. The comparative sample was similar to the sample "48" except that the materials for the ion sensing electrode 3 were designed to provide an electric resistance "r" of 0.2 Ω as in the sample "6" in FIG. 11.

During the fabrication of the sample "49", materials for the heating member 2 used $MoSi_2$ powder of electrically conductive ceramic. The materials for the heating member 2 did not use insulating ceramic. The materials for the heating member 2 were designed to provide an electric resistance R2 of 0.4 Ω. The mean grain diameter of the $MoSi_2$ powder was in the range of 1 μm to 3 μm. During the fabrication of the sample "49", materials for the ion sensing electrode 3 used $MoSi_2$ powder of electrically conductive ceramic. The materials for the ion sensing electrode 3 did not use insulating ceramic. The materials for the ion sensing electrode 3 were designed to provide an electric resistance "r" of 0.6 Ω as in the sample "3" in FIG. 11. The mean grain diameter of the $MoSi_2$ powder was in the range of 1 μm to 3 μm.

A comparative sample for the sample "49" was also made. The comparative sample was similar to the sample "49" except that the materials for the ion sensing electrode 3 were designed to provide an electric resistance "r" of 0.2 Ω as in the sample "6" in FIG. 11.

Experiments were performed on the samples "7" to "49" of the glow plug 1 and the related comparative samples of the glow plug 1. During the experiments, each of the samples "7" to "49" and the comparative samples was attached to the cylinder head 45. As shown in FIG. 3, a film of carbon 49 which had a predetermined thickness was deposited on outer surfaces of the ion sensing electrode 3 and the insulating member 11 in each of the samples "7" to "49" and the comparative samples. Then, the heating member 2 was activated by closing the switch of the relay 530 (see FIG. 6) to implement a heating process to burn the carbon 49 away from the outer surfaces of the ion sensing electrode 3 and the insulating member 11. For each of the samples "7" to "49" and the comparative samples, measurement was given of the degree of the removal of the carbon 49 from the outer surfaces of the ion sensing electrode 3 and the insulating member 11. As shown in FIGS. 12, 13, and 14, all the samples "7" to "49" were excellent in the removal of carbon. On the other hand, the comparative samples were poor in the removal of carbon.

Fourth Specific Embodiment

A fourth specific embodiment of this invention is similar to the first and second specific embodiments thereof except for design changes explained hereinafter.

With reference to FIGS. 15 and 16, samples "50" to "64" of the glow plug 1 were made. During the fabrication of the sample "50", materials for the heating member 2 were designed to provide an electric resistance R2 of 0.4 Ω. Material for the ion sensing electrode 3 used a metal wire of W having a melting point equal to or above 1,200° C. The material for the ion sensing electrode 3 was designed to provide an electric resistance "r" of 0.6 Ω as in the sample "3" in FIG. 11.

A comparative sample for the sample "50" was also made. The comparative sample was similar to the sample "50" except that the material for the ion sensing electrode 3 was designed to provide an electric resistance "r" of 0.2 Ω as in the sample "6" in FIG. 11.

During the fabrication of the sample "51", materials for the heating member 2 were designed to provide an electric resistance R2 of 0.4 Ω. Material for the ion sensing electrode 3 used a metal wire of Mo having a melting point equal to or above 1,200° C. The material for the ion sensing electrode 3 was designed to provide an electric resistance "r" of 0.6 Ω as in the sample "3" in FIG. 11.

A comparative sample for the sample "51" was also made. The comparative sample was similar to the sample "51" except that the material for the ion sensing electrode 3 was designed to provide an electric resistance "r" of 0.2 Ω as in the sample "6" in FIG. 11.

During the fabrication of the sample "52", materials for the heating member 2 were designed to provide an electric resistance R2 of 0.4 Ω. Material for the ion sensing electrode 3 used a metal wire of Ni having a melting point equal to or above 1,200° C. The material for the ion sensing electrode 3 was designed to provide an electric resistance "r" of 0.6 Ω as in the sample "3" in FIG. 11.

A comparative sample for the sample "52" was also made. The comparative sample was similar to the sample "52" except that the material for the ion sensing electrode 3 was designed to provide an electric resistance "r" of 0.2 Ω as in the sample "6" in FIG. 11.

During the fabrication of the sample "53", materials for the heating member 2 were designed to provide an electric resistance R2 of 0.4 Ω. Material for the ion sensing electrode 3 used a metal wire of Ti having a melting point equal to or above 1,200° C. The material for the ion sensing electrode 3 was designed to provide an electric resistance "r" of 0.6 Ω as in the sample "3" in FIG. 11.

A comparative sample for the sample "53" was also made. The comparative sample was similar to the sample "53" except that the material for the ion sensing electrode 3 was designed to provide an electric resistance "r" of 0.2 Ω as in the sample "6" in FIG. 11.

It should be noted that a metal wire of Cr, a metal wire of Co, a metal wire of Fe, a metal wire of Re, and a metal wire of Zr which have melting points equal to or above 1,200° C. may be used instead of the metal wire of W, the metal wire of Mo, the metal wire of Ni, and the metal wire of Ti.

During the fabrication of the sample "54", materials for the heating member 2 were designed to provide an electric resistance R2 of 0.4 Ω. Material for the ion sensing electrode 3 used an alloy wire of Fe—Cr—Ni having a melting point equal to or above 1,200° C.

The material for the ion sensing electrode 3 was designed to provide an electric resistance "r" of 0.6 Ω as in the sample "3" in FIG. 11.

A comparative sample for the sample "54" was also made. The comparative sample was similar to the sample "54" except that the material for the ion sensing electrode 3 was designed to provide an electric resistance "r" of 0.2 Ω as in the sample "6" in FIG. 11.

During the fabrication of the sample "55", materials for the heating member 2 were designed to provide an electric resistance R2 of 0.4 Ω. Material for the ion sensing electrode 3 used an alloy wire of Ni—Co having a melting point equal to or above 1,200° C. The material for the ion sensing electrode 3 was designed to provide an electric resistance "r" of 0.6 Ω as in the sample "3" in FIG. 11.

A comparative sample for the sample "55" was also made. The comparative sample was similar to the sample "55" except that the material for the ion sensing electrode 3 was designed to provide an electric resistance "r" of 0.2 Ω as in the sample "6" in FIG. 11.

During the fabrication of the sample "56", materials for the heating member 2 were designed to provide an electric resistance R2 of 0.4 Ω. Material for the ion sensing electrode 3 used an alloy wire of Fe—Co having a melting point equal to or above 1,200° C. The material for the ion sensing electrode 3 was designed to provide an electric resistance "r" of 0.6 Ω as in the sample "3" in FIG. 11.

A comparative sample for the sample "56" was also made. The comparative sample was similar to the sample "56" except that the material for the ion sensing electrode 3 was designed to provide an electric resistance "r" of 0.2 Ω as in the sample "6" in FIG. 11.

During the fabrication of the sample "57", materials for the heating member 2 were designed to provide an electric resistance R2 of 0.4 Ω. Material for the ion sensing electrode 3 used an alloy wire of W—Re having a melting point equal to or above 1,200° C. The material for the ion sensing electrode 3 was designed to provide an electric resistance "r" of 0.6 Ω as in the sample "3" in FIG. 11.

A comparative sample for the sample "57" was also made. The comparative sample was similar to the sample "57" except that the material for the ion sensing electrode 3 was designed to provide an electric resistance "r" of 0.2 Ω as in the sample "6" in FIG. 11.

During the fabrication of the sample "58", materials for the heating member 2 were designed to provide an electric resistance R2 of 0.4 Ω. Materials for the ion sensing electrode 3 used a mixture of metal powder and insulating powder. The metal powder was electrically conductive material. The metal powder was made of W having a melting point equal to or above 1,200° C. The insulating powder was made of $Si_3N_4$. The $Si_3N_4$ powder was of insulating ceramic. The mixing weight ratio between the W powder and the $Si_3N_4$ powder was chosen to provide an electric resistance "r" of 0.6 Ω as in the sample "3" in FIG. 11. The mean grain diameter of the W powder was in the range of 1 μm to 10 μm.

A comparative sample for the sample "58" was also made. The comparative sample was similar to the sample "58" except that the mixing weight ratio between the W powder and the $Si_3N_4$ powder in the materials for the ion sensing electrode 3 was chosen to provide an electric resistance "r" of 0.2 Ω as in the sample "6" in FIG. 11.

During the fabrication of the sample "59", materials for the heating member 2 were designed to provide an electric resistance R2 of 0.4 Ω. Materials for the ion sensing electrode 3 used a mixture of metal powder and insulating powder. The metal powder was electrically conductive material. The metal powder was made of Mo having a melting point equal to or above 1,200° C. The insulating powder was made of $Si_3N_4$. The $Si_3N_4$ powder was of insulating ceramic. The mixing weight ratio between the Mo powder and the $Si_3N_4$ powder was chosen to provide an electric resistance "r" of 0.6 Ω as in the sample "3" in FIG. 11. The mean grain diameter of the Mo powder was in the range of 1 μm to 10 μm.

A comparative sample for the sample "59" was also made. The comparative sample was similar to the sample "59" except that the mixing weight ratio between the Mo powder and the $Si_3N_4$ powder in the materials for the ion sensing electrode 3 was chosen to provide an electric resistance "r" of 0.2 Ω as in the sample "6" in FIG. 11.

During the fabrication of the sample "60", materials for the heating member 2 were designed to provide an electric resistance R2 of 0.4 Ω. Materials for the ion sensing electrode 3 used a mixture of metal powder and insulating powder. The metal powder was electrically conductive material. The metal powder was made of Ni having a melting point equal to or above 1,200° C. The insulating powder was made of $Si_3N_4$. The $Si_3N_4$ powder was of insulating ceramic. The mixing weight ratio between the Ni powder and the $Si_3N_4$ powder was chosen to provide an electric resistance "r" of 0.6 Ω as in the sample "3" in FIG. 11. The mean grain diameter of the Ni powder was in the range of 1 μm to 10 μm.

A comparative sample for the sample "60" was also made. The comparative sample was similar to the sample "60" except that the mixing weight ratio between the Ni powder and the $Si_3N_4$ powder in the materials for the ion sensing electrode 3 was chosen to provide an electric resistance "r" of 0.2 Ω as in the sample "6" in FIG. 11.

During the fabrication of the sample "61", materials for the heating member 2 were designed to provide an electric resistance R2 of 0.4 Ω. Materials for the ion sensing electrode 3 used a mixture of metal powder and insulating powder. The metal powder was electrically conductive material. The metal powder was made of Ti having a melting point equal to or above 1,200° C. The insulating powder was made of $Si_3N_4$. The $Si_3N_4$ powder was of insulating ceramic. The mixing weight ratio between the Ti powder and the $Si_3N_4$ powder was chosen to provide an electric resistance "r" of 0.6 Ω as in the sample "3" in FIG. 11. The mean grain diameter of the Ti powder was in the range of 1 μm to 10 μm.

A comparative sample for the sample "61" was also made. The comparative sample was similar to the sample "61" except that the mixing weight ratio between the Ti powder and the $Si_3N_4$ powder in the materials for the ion sensing electrode 3 was chosen to provide an electric resistance "r" of 0.2 Ω as in the sample "6" in FIG. 11.

It should be noted that metal powder of Cr, metal powder of Co, metal powder of Fe, metal powder of Re, and metal powder of Zr which have melting points equal to or above 1,200° C. may be used instead of the metal powder of W, the metal powder of Mo, the metal powder of Ni, and the metal powder of Ti.

During the fabrication of the sample "62", materials for the heating member 2 were designed to provide an electric resistance R2 of 0.4 Ω. Materials for the ion sensing electrode 3 used a mixture of alloy powder and insulating powder. The alloy powder was electrically conductive material. The alloy powder was made of Fe—Cr—Ni having a melting point equal to or above 1,200° C. The insulating powder was made of $Si_3N_4$. The $Si_3N_4$ powder was of insulating ceramic. The mixing weight ratio between the Fe—Cr—Ni powder and the $Si_3N_4$ powder was chosen to provide an electric resistance "r" of 0.6 Ω as in the sample "3" in FIG. 11. The mean grain diameter of the Fe—Cr—Ni powder was in the range of 1 μm to 10 μm.

A comparative sample for the sample "62" was also made. The comparative sample was similar to the sample "62" except that the mixing weight ratio between the Fe—Cr—Ni powder and the $Si_3N_4$ powder in the materials for the ion sensing electrode 3 was chosen to provide an electric resistance "r" of 0.2 Ω as in the sample "6" in FIG. 11.

During the fabrication of the sample "63", materials for the heating member 2 were designed to provide an electric resistance R2 of 0.4 Ω. Materials for the ion sensing electrode 3 used a mixture of alloy powder and insulating powder. The alloy powder was electrically conductive material. The alloy powder was made of Ni—Co having a melting point equal to or above 1,200° C. The insulating powder was made of $Si_3N_4$. The $Si_3N_4$ powder was of insulating ceramic. The mixing weight ratio between the Ni—Co powder and the $Si_3N_4$ powder was chosen to provide an electric resistance "r" of 0.6 Ω as in the sample "3" in FIG. 11. The mean grain diameter of the Ni—Co powder was in the range of 1 μm to 10 μm.

A comparative sample for the sample "63" was also made. The comparative sample was similar to the sample "63" except that the mixing weight ratio between the Ni—Co powder and the $Si_3N_4$ powder in the materials for the ion sensing electrode 3 was chosen to provide an electric resistance "r" of 0.2 Ω as in the sample "6" in FIG. 11.

During the fabrication of the sample "64", materials for the heating member 2 were designed to provide an electric resistance R2 of 0.4 Ω. Materials for the ion sensing electrode 3 used a mixture of alloy powder and insulating powder. The alloy powder was electrically conductive material. The alloy powder was made of Fe—Co having a melting point equal to or above 1,200° C. The insulating powder was made of $Si_3N_4$. The $Si_3N_4$ powder was of insulating ceramic. The mixing weight ratio between the Fe—Co powder and the $Si_3N_4$ powder was chosen to provide an electric resistance "r" of 0.6 Ω as in the sample "3" in FIG. 11. The mean grain diameter of the Fe—Co powder was in the range of 1 μm to 10 μm.

A comparative sample for the sample "64" was also made. The comparative sample was similar to the sample "64" except that the mixing weight ratio between the Fe—Co powder and the $Si_3N_4$ powder in the materials for the ion sensing electrode 3 was chosen to provide an electric resistance "r" of 0.2 Ω as in the sample "6" in FIG. 11.

It should be noted that alloy powder of W—Re having a melting point equal to or above 1,200° C. may be used instead of the alloy powder of Fe—Cr—Ni, the alloy powder of Ni—Co, or the alloy powder of Fe—Co.

Experiments were performed on the samples "50" to "64" of the glow plug 1 and the related comparative samples of the glow plug 1. During the experiments, each of the samples "50" to "64" and the comparative samples was attached to the cylinder head 45.

As shown in FIG. 3, a film of carbon 49 which had a predetermined thickness was deposited on outer surfaces of the ion sensing electrode 3 and the insulating member 11 in each of the samples "50" to "64" and the comparative samples. Then, the heating member 2 was activated by closing the switch of the relay 530 (see FIG. 6) to implement a heating process to burn the carbon 49 away from the outer surfaces of the ion sensing electrode 3 and the insulating member 11. For each of the samples "50" to "64" and the comparative samples, measurement was given of the degree of the removal of the carbon 49 from the outer surfaces of the ion sensing electrode 3 and the insulating member 11. As shown in FIGS. 15 and 16, all the samples "50" to "64" were excellent in the removal of carbon. On the other hand, the comparative samples were poor in the removal of carbon.

Fifth Specific Embodiment

Figure 17:
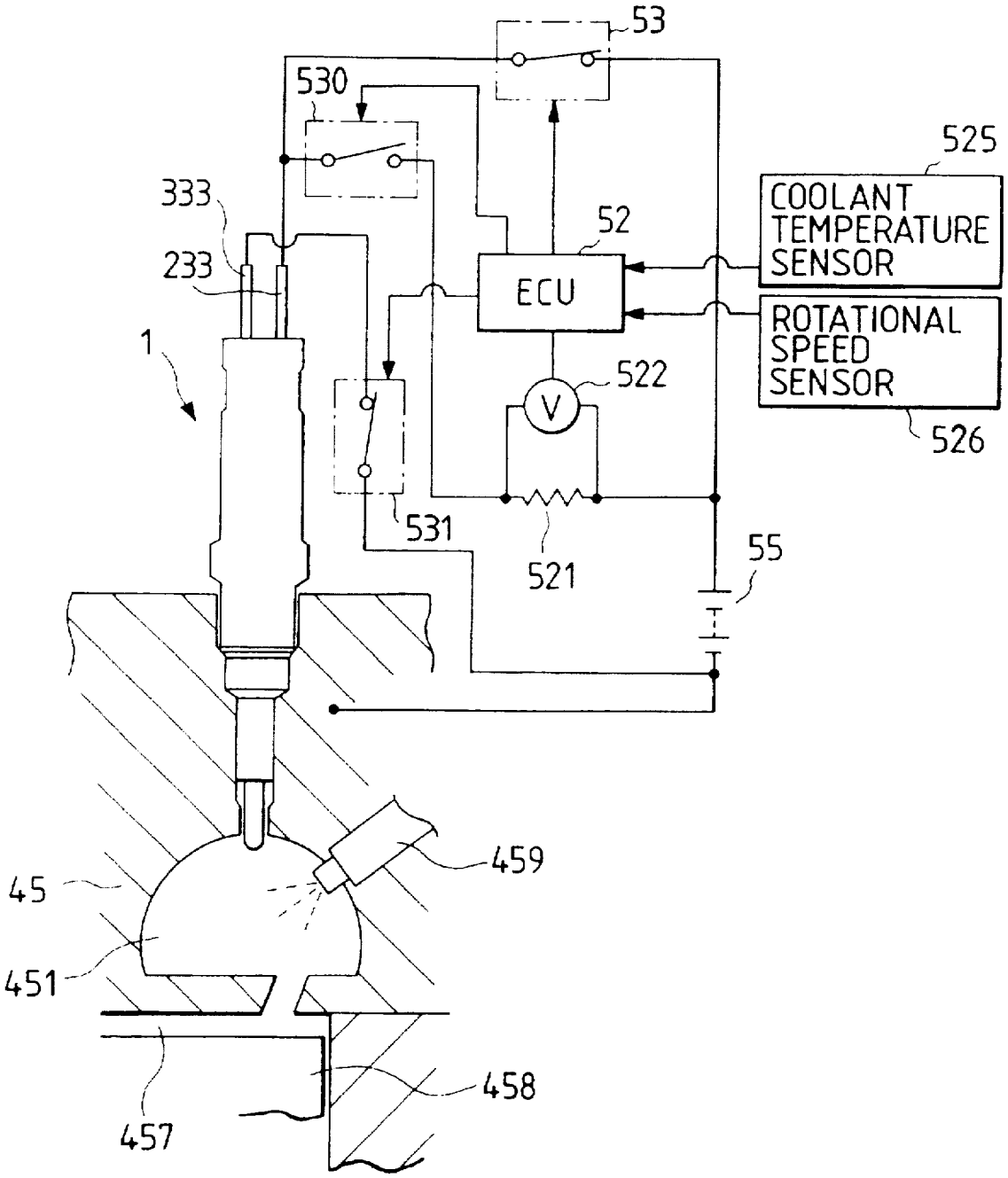
FIG. 17 is a diagram of a glow plug and a drive circuit for the glow plug according to a fifth specific embodiment of this invention.

FIG. 17 shows a fifth specific embodiment of this invention which is similar to the embodiment of FIG. 6 except for design changes indicated hereinafter. The embodiment of FIG. 17 includes a battery 55 instead of the dc power supply 51 (see FIG. 6). The battery 54 (see FIG. 7) is omitted from the embodiment of FIG. 17. In the embodiment of FIG. 17, the lead wire 233 is electrically connected to the positive terminal of the battery 55 via the relay 53. The lead wire 333 is electrically connected to the negative terminal of the battery 55 via the relay 531.

In the case where the heating member in the glow plug 1 is required to implement a heating process, the relays 53 and 531 are changed to their on positions while the relay 530 is set to its off position. During the detection of an ion current, the relay 530 is in its on position while the relays 53 and 531 are in their off positions.

The embodiment of FIG. 17 is advantageous since the electric-circuit structure thereof is relatively simple.

Sixth Specific Embodiment

Figure 18:
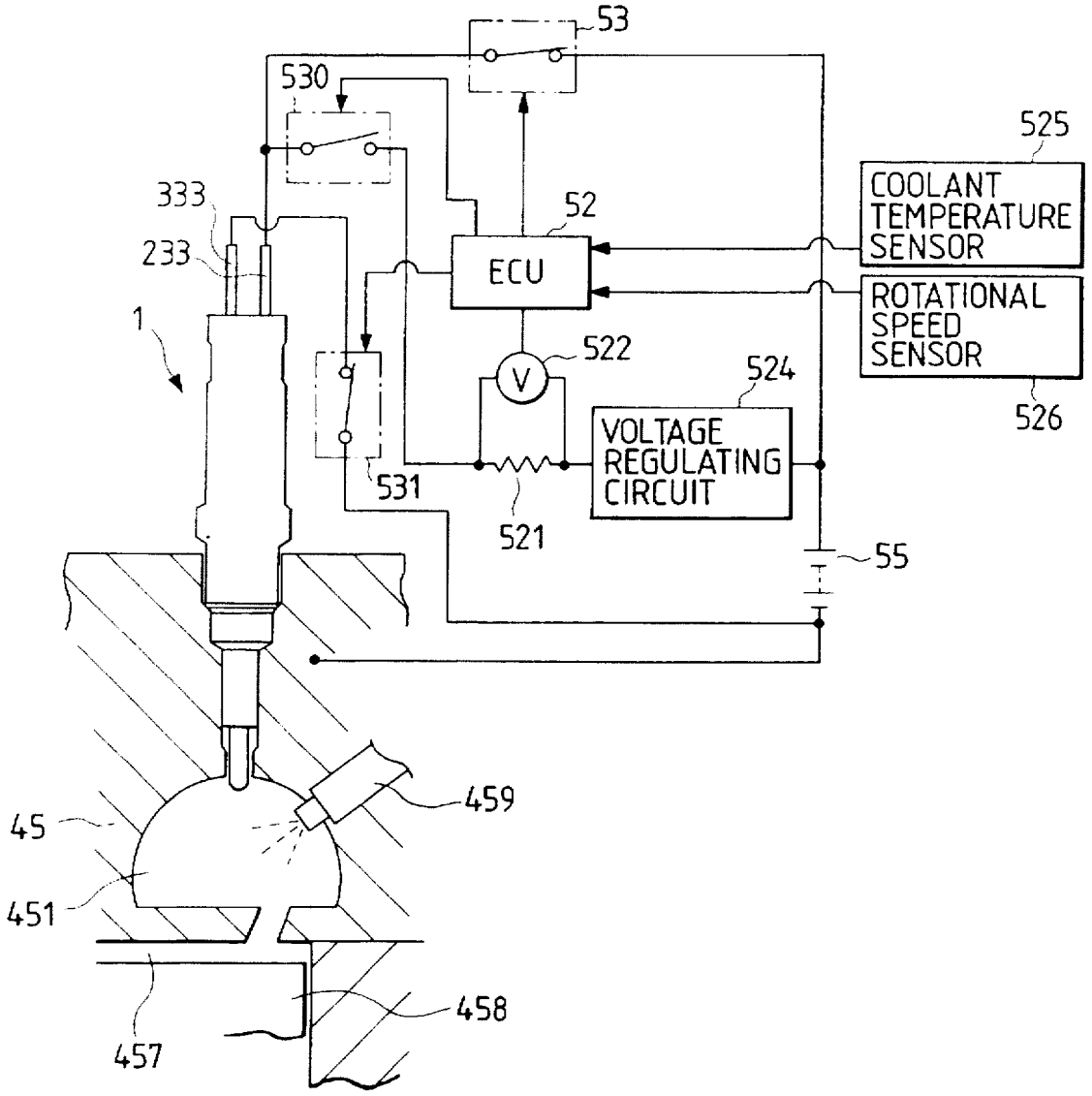
FIG. 18 is a diagram of a glow plug and a drive circuit for the glow plug according to a sixth specific embodiment of this invention.

FIG. 18 shows a sixth specific embodiment of this invention which is similar to the embodiment of FIG. 17 except for an additional design indicated hereinafter. The embodiment of FIG. 18 includes a voltage regulating circuit 524 connected between the battery 55 and the fixed resistor 521. The voltage regulating circuit 524 stabilizes the voltage applied to the ion sensing electrode within the glow plug 1. The stabilization of the applied voltage provides stable detection of the ion current.

Seventh Specific Embodiment

Figure 19:
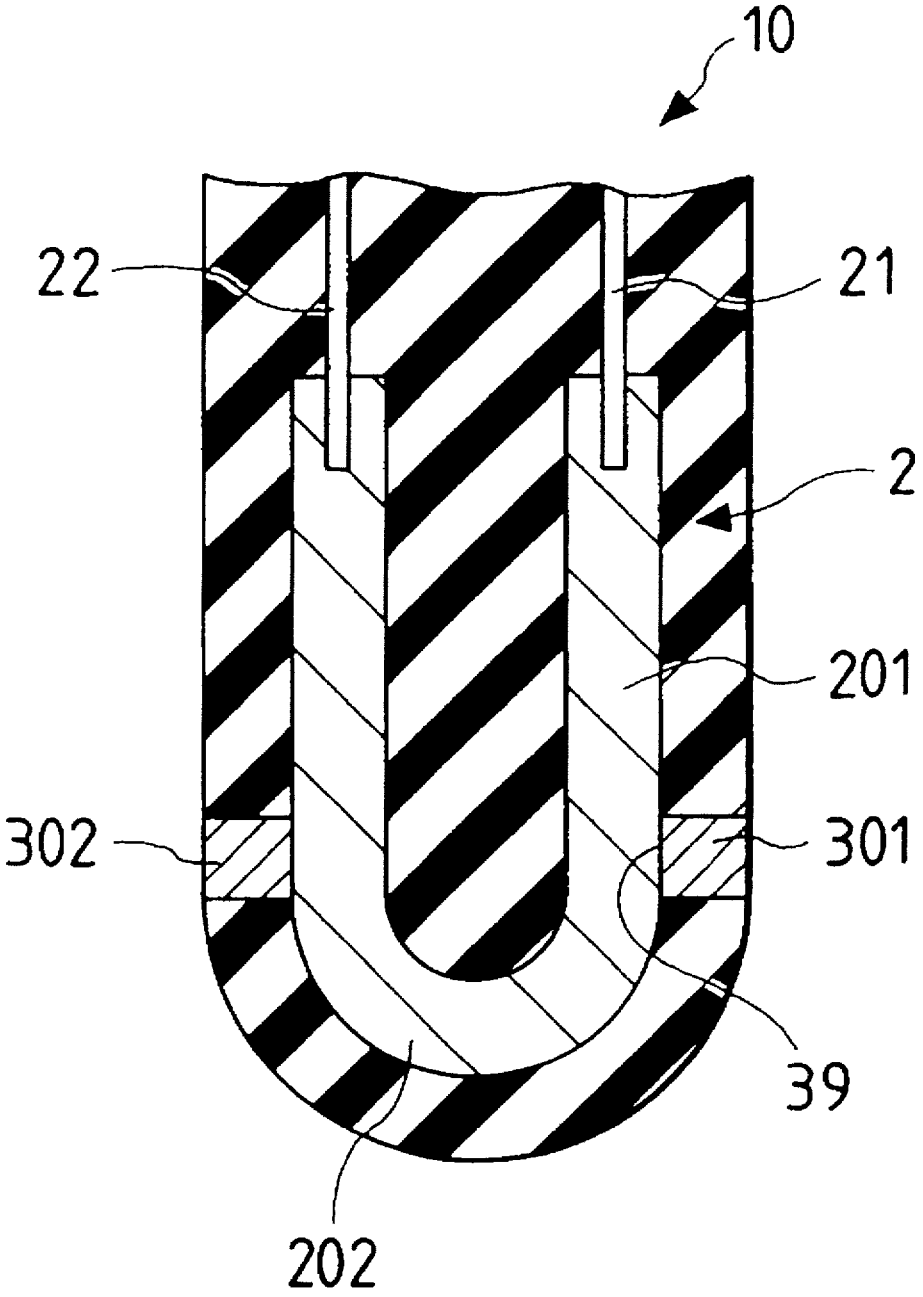
FIG. 19 is a sectional view of a portion of a glow plug according to a seventh specific embodiment of this invention.

FIG. 19 shows a seventh specific embodiment of this invention which is similar to the first specific embodiment thereof except for a design change indicated hereinafter. The embodiment of FIG. 19 includes ion sensing electrodes 301 and 302 instead of the ion sensing electrode 3 (see FIG. 1). The ion sensing electrodes 301 and 302 are electrically connected to a right-hand side and a left-hand side of the U-shaped heating member 2 respectively. The ion sensing electrodes 301 and 302 extend from the U-shaped heating member 2 to outer surfaces of the main body 10 of the glow plug.

The junction between the ion sensing electrode 301 and the heating member 2 is closer to the positive end of the heating member 2 than the junction between the ion sensing electrode 302 and the heating member 2 is. The heating member 2 is divided into two regions 201 and 202. The first region 201 of the heating member 2 extends between the positive end thereof and a center with respect to the junction 39 between the heating member 2 and the ion sensing electrode 301. The second region 202 of the heating member 2 extends between the negative end thereof and the center with respect to the junction 39 between the heating member 2 and the ion sensing electrode 301.

During a process of burning carbon away from outer surfaces of the ion sensing electrodes 301 and 302 and the glow-plug main body 10, a heating electric current is driven through the first region 201 and the second region 202 of the heating member 2 so that the first region 201 and the second region 202 of the heating member 2 are activated and heated.

Since there are the two ion sensing electrodes 301 and 302, it is possible to accurately detect an ion current.

What is claimed is:

1. A glow plug comprising:

an insulating member;

a heating member provided in the insulating member; and an electrode provided in the insulating member and electrically connected to the heating member for sensing an ion current, the electrode having a surface uncovered from the insulating member;

wherein an electric resistance of a portion of the heating member between an end of the heating member and the electrical connection with the electrode is smaller than an electric resistance of the electrode between the surface of the electrode and the electrical connection with the heating member.

2. A glow plug comprising:

a housing;

a main body at least partially disposed in the housing and supported with respect to the housing;

an insulating member included in the main body;

a heating member provided in the insulating member;

a pair of lead wires electrically connected to two ends of the heating member respectively and extending out of the insulating member; and at least one ion sensing electrode provided in the insulating member and electrically connected to the heating member for detecting a condition of ionization in a flame;

wherein the ion sensing electrode has a tip uncovered from the insulating member so as to be exposed to the flame; and wherein the heating member has a given portion extending between a center with respect to the electrical connection with the ion sensing electrode and an end of the heating member which is a negative side when a heating dc current is driven through the heating member, and an electric resistance of the given portion of the heating member is smaller than an electric resistance of the ion sensing electrode between its tip and the electrical connection with the heating member.

3. A glow plug as set forth in claim 2, wherein the ion sensing electrode is made from an electrically conductive ceramic material or from a mixture of the electrically conductive ceramic material and an insulating ceramic material, and a main component of the electrically conductive ceramic material includes at least one of metal silicide, metal carbide, metal nitride, and metal boride.

4. A glow plug as set forth in claim 2, wherein the ion sensing electrode is made from a high-melting-point metal material whose main component includes at least one metal material having a melting point equal to or above 1,200° C., or is made from a mixture of the high-melting-point metal material and an insulating ceramic material.

5. A glow plug as set forth in claim 2, wherein the tip of the ion sensing electrode has a coating of at least one of Pt, Ir, Rh, Ru, and Pd.

* * * * *